US010511105B2

(12) United States Patent
Sato et al.

(10) Patent No.: US 10,511,105 B2
(45) Date of Patent: Dec. 17, 2019

(54) ELECTRIC WIRE WITH TERMINAL AND METHOD OF MANUFACTURING ELECTRIC WIRE WITH TERMINAL

(71) Applicant: Yazaki Corporation, Tokyo (JP)

(72) Inventors: Tomoya Sato, Shizuoka (JP); Naoki Ito, Shizuoka (JP); Yasunori Nabeta, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/287,444

(22) Filed: Feb. 27, 2019

(65) Prior Publication Data

US 2019/0273327 A1 Sep. 5, 2019

(30) Foreign Application Priority Data

Mar. 1, 2018 (JP) ..... 2018-036334

(51) Int. Cl.
*H01R 4/02* (2006.01)
*H01R 43/02* (2006.01)

(52) U.S. Cl.
CPC ..... *H01R 4/029* (2013.01); *H01R 4/023* (2013.01); *H01R 43/0207* (2013.01)

(58) Field of Classification Search
CPC ..... H01R 43/0207; H01R 39/36; H01R 43/0484; H01R 4/029; H01R 13/58; H01R 4/023
USPC ..... 439/874
See application file for complete search history.

(56) References Cited

U.S. PATENT DOCUMENTS

| | | | | |
|---|---|---|---|---|
| 3,148,295 | A * | 9/1964 | Paxton | H01R 39/36 310/249 |
| 2019/0165489 | A1* | 5/2019 | Sato | H01R 43/0484 |
| 2019/0165532 | A1* | 5/2019 | Sato | H01R 43/0207 |

FOREIGN PATENT DOCUMENTS

| | | | |
|---|---|---|---|
| JP | 44-4295 | Y | 2/1969 |
| JP | 58-120566 | U | 8/1983 |
| JP | 4-111150 | U | 9/1992 |
| JP | 2015-115240 | A | 6/2015 |
| JP | 2015-135742 | A | 7/2015 |

* cited by examiner

*Primary Examiner* — Jean F Duverne
(74) *Attorney, Agent, or Firm* — Sughrue Mion, PLLC

(57) ABSTRACT

A terminal-equipped electric wire includes a terminal and an electric wire. The terminal includes a conductor bonding part and a sheath supporting part. The electric wire includes a conductor formed of a plurality of strands and a sheath covering the conductor such that the conductor is exposed to a predetermined length. The conductor exposed from the sheath is bonded to the conductor bonding part, and the sheath is supported by the sheath supporting part and is fixed in the terminal. The sheath supporting part is in a state where there is no permanent distortion with respect to a state when the terminal is present alone.

7 Claims, 14 Drawing Sheets

ELECTRIC WIRE WITH TERMINAL AND METHOD OF MANUFACTURING ELECTRIC WIRE WITH TERMINAL

CROSS REFERENCE TO RELATED APPLICATION

This application is based upon and claims the benefit of priority from the prior Japanese Patent Application No. 2018-036334 (filing date: Mar. 1, 2018), the entire contents of which are incorporated herein by reference.

BACKGROUND

Technical Field

The present invention relates to a terminal-equipped electric wire and a method of manufacturing a terminal-equipped electric wire, and in particular, to a terminal-equipped electric wire and a method of manufacturing a terminal-equipped electric wire, wherein a conductor of the electric wire is, for example, ultrasonically bonded to a terminal, and a sheath of the electric wire is supported by a sheath supporting part of the terminal.

Related Art

Conventionally a terminal-equipped electric wire has been known, which has an electric wire and a terminal (see JP 2015-135742 A).

In the terminal-equipped electric wire, a portion of a conductor which is not covered with the sheath, and a part of the terminal are clamped between an anvil and a horn, and the horn is ultrasonically vibrated, thereby bonding the conductor of the electric wire to the terminal (ultrasonic bonding).

In addition, a bonded portion where strands constituting the conductor are bonded to each other is formed in a portion of the conductor bonded to the terminal.

On the other hand, since a plurality of strands and a terminal are clamped between an anvil and a horn and ultrasonic bonding is performed in a conventional terminal-equipped electric wire, it is apprehended that bonding of the conductor to the terminal is not ensured.

Also, since the conductor (a bonded portion) is bonded to a planar portion of the terminal in the conventional terminal-equipped electric wire, it is apprehended that the bonded portion peels off from the terminal when a force or a moment for peeling the bonded portion from the terminal is applied.

In this regard, it is considered to provide the terminal with an insulation barrel portion and swage the insulation barrel portion to hold the sheath of the electric wire (an end on side of the bonded portion) so as to prevent peeling of the bonded portion from the terminal.

However, if the insulation barrel portion is provided and the insulation barrel portion is swaged to hold the sheath, the manufacturing process becomes complicated.

SUMMARY

The present invention has been made in consideration of the above problems, and it is an object of the present invention to provide a terminal-equipped electric wire in which a conductor of the electric wire is bonded to a terminal, which prevent a bonded portion of the conductor bonded to the terminal from peeling off from the terminal and to simplify manufacturing processing, and a method for manufacturing the terminal-equipped electric wire.

A terminal-equipped electric wire according to first aspect of the present invention includes a terminal and an electric wire. The terminal includes a conductor bonding part and a sheath supporting part. The electric wire includes a conductor formed of a plurality of strands and a sheath covering the conductor such that the conductor is exposed to a predetermined length. The conductor exposed from the sheath is bonded to the conductor bonding part, and the sheath is supported by the sheath supporting part and is fixed in the terminal. The sheath supporting part is in a state where there is no permanent distortion with respect to a state when the terminal is present alone.

The sheath supporting part may support the electric wire with an urging force.

The sheath supporting part may be a part of the terminal where a through hole is formed, and the electric wire may pass through the through hole and the sheath of the electric wire may be supported by the sheath supporting part by contacting an inner wall of the terminal defining the through hole.

The terminal may be formed in a shape in which a flat plate-like material is bent in at least one portion to form a bent portion. The conductor bonding part may be formed in one region of a plurality of regions partitioned by the bent portion and the sheath supporting part may be formed in another region of the plurality of regions partitioned by the bent portion.

The terminal may include a flat plate-like terminal body and a protruding part protruding from a plane of the flat plate-like terminal body in a thickness direction of the flat plate-like terminal body. The conductor bonding part may be formed in a first part of the flat plate-like terminal body. The sheath supporting part may be formed in an annular shape, along with the protruding part and a second part of the flat plate-like terminal body. The electric wire may pass through the sheath supporting part having the annular shape and the sheath of the electric wire may be supported by the sheath supporting part by contacting at least the protruding part.

The protruding part may include a first protruding portion formed on a first region in the second part and protruding from a plane on one side of the flat plate-like terminal body in the plate thickness direction and a second protruding portion formed on a second region in the second part and protruding from a plane on the other side of the flat plate-like terminal body in the plate thickness direction. The first protruding portion, the second protruding portion, and the conductor bonding part may be linearly arranged in this order in a longitudinal direction of the electric wire. The sheath supporting part may include the first protruding portion and the second protruding portion. The electric wire may be supported by the sheath supporting part by contacting the first protruding portion and the second protruding portion.

A method for manufacturing a terminal-equipped electric wire according to second aspect of the present invention is a method for manufacturing a terminal-equipped electric wire by fixing the electric wire including a conductor formed of a plurality of strands and a sheath configured to cover the conductor such that the conductor is exposed to a predetermined length, to the terminal including a conductor bonding part and a sheath supporting part. The method includes supporting the sheath of the electric wire with the sheath supporting part being in a state where there is no permanent distortion with respect to a state when the terminal is present alone. An exposed conductor of the electric wire is bonded to the conductor bonding part of the terminal.

According to the aspects of the present invention provide a terminal-equipped electric wire in which a conductor of the electric wire is bonded to a terminal, which prevent a bonded portion of the conductor bonded to the terminal from peeling off from the terminal and to simplify manufacturing processing, and a method for manufacturing the terminal-equipped electric wire.

DETAILED DESCRIPTION

Figure 1:
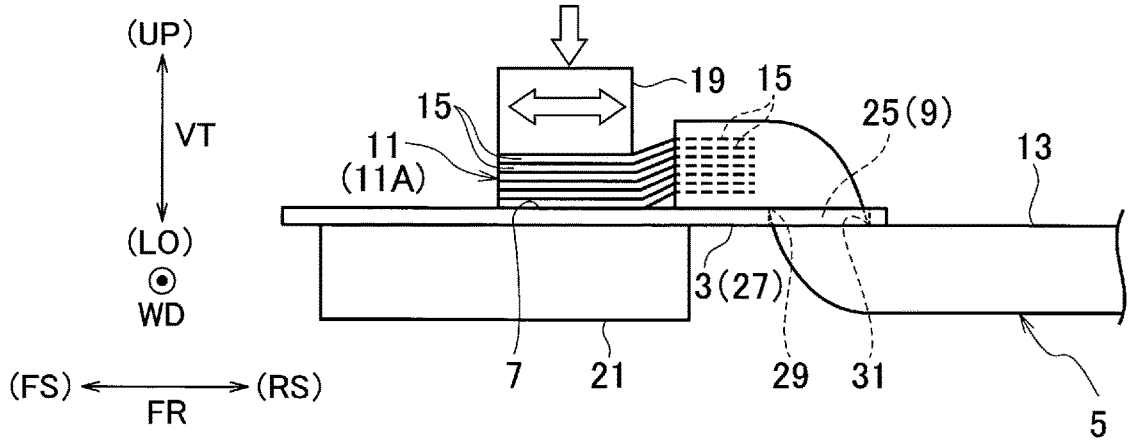
FIG. 1 is a diagram illustrating a method of manufacturing a terminal-equipped electric wire according to an embodiment of the present invention.
Figure 2:
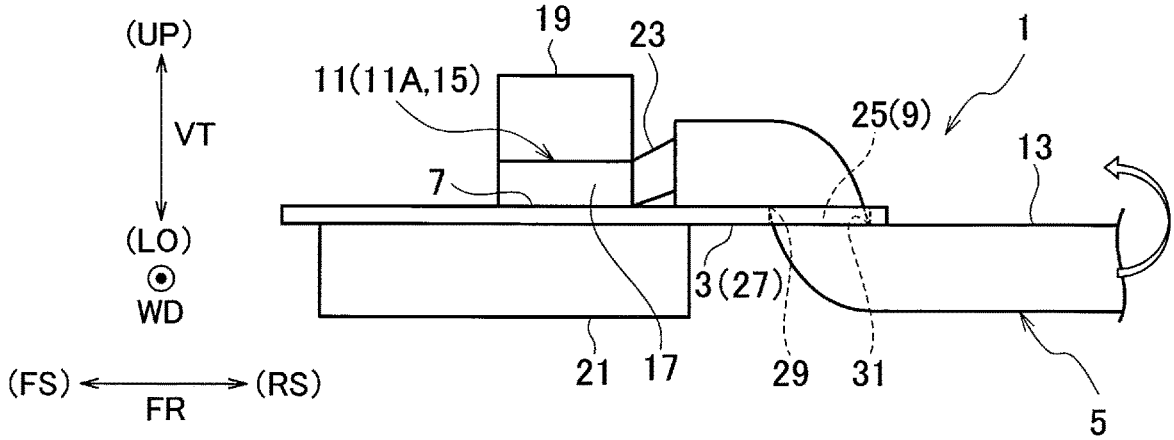
FIG. 2 is a diagram illustrating a terminal-equipped electric wire according to an embodiment of the present invention.

As illustrated in FIGS. 1 and 2, a terminal-equipped electric wire 1 according to the embodiment of the present invention is configured to include a terminal 3 and an electric wire 5 fixed to the terminal 3.

Here, for convenience of explanation, a longitudinal direction of the electric wire 5 (a terminal-equipped electric wire 1) is defined as the front rear direction FR, a predetermined direction orthogonal to the front rear direction FR is defined as a vertical direction VT, and a direction orthogonal to the front rear direction FR and the vertical direction VT is defined as a width direction WD.

A conductor bonding part 7 and a sheath supporting part 9 are fixed in the terminal 3. A conductor 11 of the electric wire 5 is bonded to the conductor bonding part 7 and the sheath supporting part 9 supports the sheath 13 of the electric wire 5.

The conductor 11 of the electric wire 5 is configured by a plurality of strands 15, and the sheath 13 of the electric wire 5 covers the conductor 11 so that the conductor 11 is exposed throughout a predetermined length.

In the electric wire 1 with a terminal, an exposed part of the conductor (exposed conductor) 11A is directly bonded to the conductor bonding part 7 and the sheath 13 is directly supported by the sheath supporting part 9.

Supporting the sheath 13 by the sheath supporting part 9 is performed, for example, to prevent peeling of the conductor 11 bonded to the conductor bonding part 7 from the conductor bonding part 7. In other words, it is made to increase a resistance force against peeling of the conductor 11 bonded to the conductor bonding part 7.

In addition, in the terminal-equipped electric wire 1, the sheath supporting part 9 of the terminal 3 is in a state where there is no permanent distortion with respect to a state when the terminal 3 is present alone, that is, a state before the electric wire 5 is fixed in the terminal 3 or a state before the sheath 13 of the electric wire 5 is supported.

That is, in the terminal-equipped electric wire 1, the sheath supporting part 9 supports the sheath 13 of the electric wire 5 in a state in which plastic deformation due to swaging or the like does not occur in the sheath supporting part 9 of the terminal 3, or even in a state in which the sheath supporting part 9 is elastically deformed very slightly.

More specifically, the maximum value of an internal stress (residual stress) in the sheath supporting part 9 of the terminal-equipped electric wire 1 (the value of a portion having the largest internal stress) is substantially equal to the maximum value of the internal stress (the value of the portion having the largest internal stress) when the terminal 3 is present alone (when external force other than the gravity is not applied to the terminal 3).

Alternatively, the maximum value of the internal stress of the sheath supporting part 9 of the terminal-equipped electric wire 1 is equal to or less than a sum obtained by adding the maximum value of the internal stress when the terminal 3 is present alone and a small stress value within a proportional limit of the material constituting the sheath supporting part 9.

The electric wire 5 will be described in detail below.

The strands 15 of the conductor 11 of the electric wire 5 are formed in an elongated cylindrical shape made of a metal such as copper, aluminum, aluminum alloy or the like. The conductor 11 is configured in a form in which a plurality of strands 15 are twisted, or a form in which a plurality of strands 15 are bunched together and linearly extended.

In addition, the electric wire 5 is flexible. The cross-section of a portion where the sheath 13 of the electric wire 5 is present (cross-section taken along a plane orthogonal to the longitudinal direction) is formed into a predetermined shape such as a circular shape.

The cross section of the conductor 11 at the portion of the electric wire 5 where the sheath 13 is present is formed in a generally circular shape because a plurality of the strands 15 are bundled in a state of almost no gap therebetween. The cross section of the sheath 13 at the portion of the electric wire 5 where the sheath 13 is present is formed in an annular shape with a predetermined width (thickness). The entire of the inner circumference of the sheath 13 is in contact with the entire of the outer circumference of the conductor 11.

The sheath 13 of the electric wire 5 covers the conductor 11 such that the conductor 11 is exposed at a part in the longitudinal direction (for example, a front end).

Therefore, the bonded portion (conductor bonded portion) 17 where the strands 15 are bonded to each other is formed in the exposed part of the conductor (exposed conductor) 11A (a portion apart from the sheath 13 by a predetermined distance in the front rear direction FR). In the conductor bonded portion 17, the conductor 11 is, for example, made into a single wire.

Therefore, the conductor bonded portion 17 is bonded to the conductor bonding part 7 and a portion on side of the exposed conductor 11A of the sheath 13 (the front end) is supported by the sheath supporting part 9.

As illustrated in FIGS. 1 and 2, the formation of the conductor bonded portion 17 and the bonding of the conductor bonded portion 17 to the conductor bonding part 7 is performed by ultrasonic bonding using the horn 19 and the anvil 21 (an ultrasonic treatment) in a single step.

More specifically, the distal end (front end) of the conductor 11 (each strand 15) of the electric wire 5 and the conductor bonding part 7 of the terminal 3 are clamped between the horn 19 and the anvil 21, and horn 19 in contact with the conductor 11 is then ultrasonically vibrated in, for example, the front rear direction FR, thereby forming the conductor bonded portion 17 and bonding the conductor bonded portion 17 to the conductor bonding part 7.

In a middle portion 23 formed between the conductor bonded portion 17 and the sheath 13 in the front rear direction FR or the portion of the conductor 11 covered with the sheath 13, the strands 15 are in a non-bonded state.

In addition, the conductor bonded portion 17 are formed in, for example, a rectangular parallelepiped (quadrangular prism shape), and the dimension thereof in the width direction WD is larger than the dimension thereof in the vertical direction VT. Furthermore, when viewed in the front rear direction FR, the conductor 11 at the portion covered with the sheath 13 has a circular shape as described above.

The cross-sectional shape of the conductor bonded portion 17 (the cross-sectional shape taken along a plane orthogonal to the front rear direction FR) is smaller than the cross-sectional shape of the portion of the conductor 11 covered with the sheath 13. The cross-sectional shape of the middle portion 23 gradually changes from the circular shape of the portion covered with the sheath 13 to the rectangular shape of the conductor bonded portion 17.

When viewed in the front rear direction FR, the rectangular conductor bonded portion 17 is positioned inside the circular conductor 11 covered with the sheath 13, and the center of the conductor 11 covered with the sheath 13 and the center of the conductor bonded portion 17 are, for example, mutually coincident. The center of the conductor 11 covered with the sheath 13 and the center of the conductor bonded portion 17 may be slightly misaligned.

Peeling of the electric wire 5 (conductor 11; conductor bonded portion 17) bonded to the conductor bonding part 7 from the conductor bonding part 7 will be described.

With respect to the above peeling, it is assumed that the conductor bonding part 7 is positioned on the lower side and the conductor 11 (conductor bonded portion 17) is bonded onto the conductor bonding part 7, and the terminal 3 is secured. When the conductor 11 bonded to the conductor bonding part 7 is pulled upward, that is, in the direction in which the sheath 13 of the electric wire 5 is spaced apart from the conductor bonding part 7, a rotational moment is generated in the conductor 11 (conductor bonded portion 17) and therefore, the conductor 11 peels off from the conductor bonding part 7.

Figure 3A:
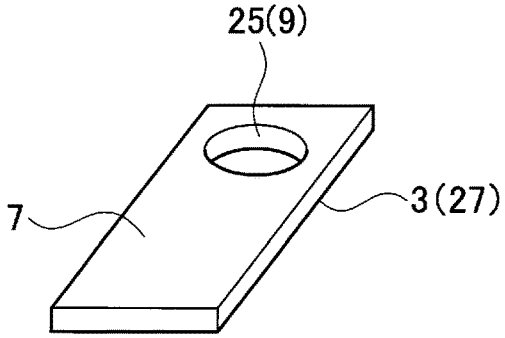
FIG. 3A is a perspective view of a terminal-equipped electric wire according to an embodiment of the present invention.
Figure 3B:
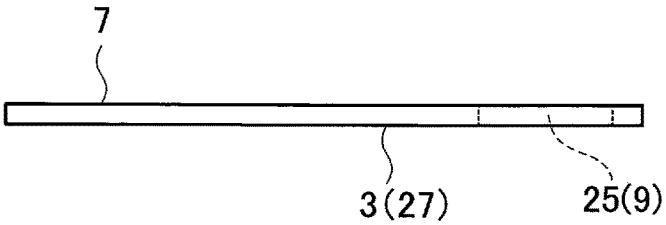
FIG. 3B is a side view of a terminal-equipped electric wire according to an embodiment of the present invention.

As illustrated in FIGS. 3A and 3B, the sheath supporting part 9 is formed in a part of the terminal 3 in which a through hole 25 is formed. Therefore, as illustrated in FIG. 2, the electric wire 5 is inserted into through hole 25, the sheath 13 of the electric wire 5 contacts the inner wall of the terminal 3 defining the through hole 25, so that the electric wire 5 (the sheath 13 of the electric wire 5) is supported by the sheath supporting part 9.

The terminal 3 is made of a conductive material such as a metal and, as illustrated in FIGS. 3A and 3B, is configured to include, for example, a rectangular flat plate-like portion 27 elongated in the front rear direction FR. The through hole 25 formed in the sheath supporting part 9 is formed in, for example, a circular shape, and passes through the flat plate-like portion 27 in a part of the flat plate-like portion 27 (rear end) in a plate thickness direction.

The conductor bonding part 7 is formed on side of the other end (on side of the front end) of the flat plate-like portion 27, and the conductor bonded portion 17 of the electric wire 5 is bonded to one-sided surface (upper side surface) in the plate thickness direction of the conductor bonding part 7.

The electric wire 5 extends to the rear side from the conductor bonded portion 17 bonded to the conductor bonding part 7. More specifically, the sheath 13 of the electric wire 5 covers the conductor 11 on the rear side from the position between the conductor bonding part 7 and the through hole 25. The conductor 11 and the sheath 13 covering the conductor 11 pass through the through hole 25 from the upper surface (front side) to the lower surface (rear side).

Therefore, the electric wire 5 (the conductor 11 and the sheath 13) is curved at the through hole 25 and in the vicinity of the through hole 25 in the front rear direction FR and is positioned on the lower side of the flat plate-like portion 27 on the rear side than a position spaced apart from the through hole 25 a predetermined distance and extends to the rear side.

The outer diameter of the sheath 13 is equal to the diameter of the through hole 25, is slightly smaller than the diameter of the through hole 25, or is slightly larger than the diameter of the through hole 25 in a state in which the electric wire 5 does not pass through the through hole 25.

Herein, description will be given by taking, as an example, a case where the outer diameter of the sheath 13 in the urged state of the sheath 13 of the electric wire 5 by the through hole 25 is equal to the diameter of the through hole 25 or is slightly smaller than the diameter of the through hole 25 in a state in which the electric wire 5 does not pass through the through hole 25 in the terminal-equipped electric wire 1.

When viewing a state where the conductor bonded portion 17 is bonded to the conductor bonding part 7 and the electric wire 5 passes through the through hole 25 (a state where the electric wire 5 is supported by the sheath supporting part 9) in the longitudinal direction of the electric wire 5 (in the longitudinal direction of the electric wire 5 which is not necessarily limited to the front rear direction FR because there is a bent portion in the electric wire 5), at least a part of the sheath 13 of the electric wire 5 is in contact with the inner wall of the terminal 3 defining the through hole 25.

The part of the sheath 13 which is in contact with the inner wall of the terminal 3 defining the through hole 25 is urged by the inner wall of the terminal 3 defining the through hole 25 and is deformed (for example, elastically deformed) within a range not to be damaged.

More specifically, as illustrated in FIG. 2, since the electric wire 5 is bent through the through hole 25, the outer shape of the electric wire 5 at the through hole 25 (the outer shape of a cross section taken along a plane orthogonal to the vertical direction VT) should be elliptical, but since the inner wall of the terminal 3 defining the through hole 25 is present, it does not actually become an ellipse.

That is, the sheath 13 of the electric wire 5 is clamped between the portion indicated by the reference numeral 29 (the front side portion of the through hole 25) in FIG. 2 and the portion indicated by the reference numeral 31 (the rear side portion of the through hole 25). and is urged and deformed.

As a result, the sheath supporting part 9 supports the electric wire 5 with the urging force. Then, when a force to peel off the conductor bonded portion 17 from the terminal 3 is applied to the electric wire 5, the conductor is further urged (pushed) toward the sheath supporting part 9 to prevent peeling of the conductor 11 bonded to the conductor bonding part 7.

In addition, in the terminal-equipped electric wire 1, the portions 29 and 31 of the through hole 25 are elastically deformed only to a very small extent (to the extent that it is hardly detected) by reaction force received from the sheath 13 of the electric wire 5.

Furthermore, even when it is attempted to peel the electric wire 5 from the terminal 3 in the terminal-equipped electric wire 1, the front side portion 29 of the through hole 25 and the rear side portion 31 of the through hole 25 are only slightly elastically deformed.

Figure 4A:
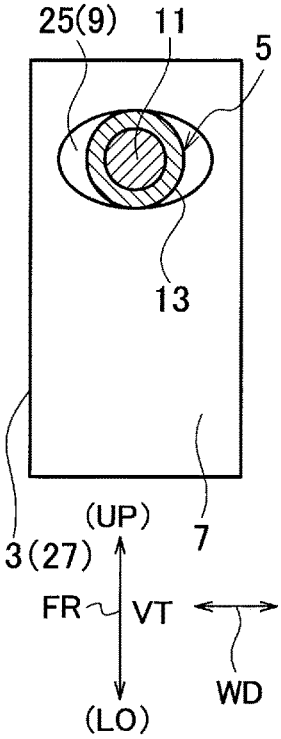
FIG. 4A is a diagram illustrating a state in which an electric wire pass through a through hole (through hole according to a modification) formed in a sheath supporting part of a terminal.
Figure 4B:
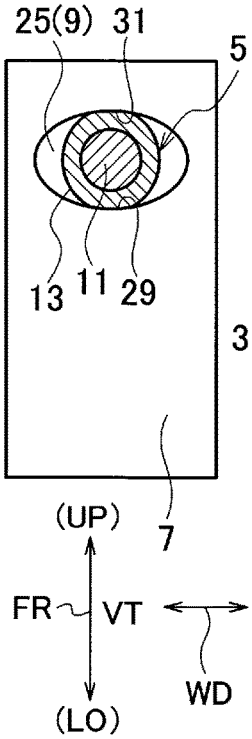
FIG. 4B is a diagram illustrating a state in which a conductor is bonded to a conductor bonding part and a sheath of the electric wire is urged and deformed by wall surfaces defining the through hole from the state of FIG. 4A.

As illustrated in FIGS. 4A and 4B, the through hole 25 may be formed in an elliptical shape. In this case, the minor axis of the ellipse extends in the front rear direction FR, and the major axis of the ellipse extends in the width direction WD.

FIG. 4A illustrates a state in which the electric wire 5 passes through the through hole 25 (a state extending in a direction orthogonal to the plane of the paper in FIG. 4A), and FIG. 4B illustrates a state in which the electric wire 5 passing through the through hole 25 is bent around the through hole 25 as illustrated in FIG. 2.

In FIG. 4B, two parts of the sheath 13 of the electric wire 5 are deformed by being urged by the front side portion 29 of the through hole 25 and the rear side portion 31 of the through hole 25.

Figure 4C:
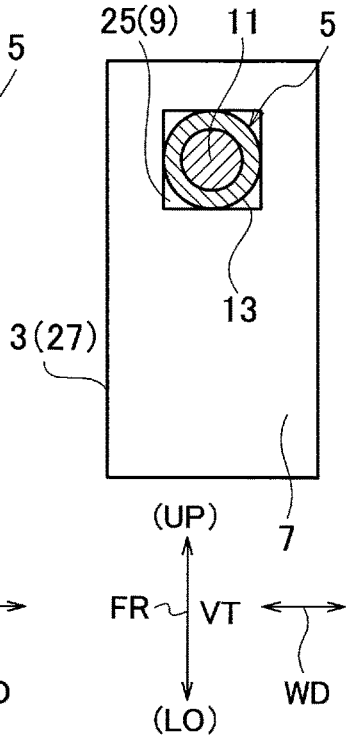
FIG. 4C is a diagram illustrating a state in which an electric wire pass through a through hole (through hole according to a modification) formed in a sheath supporting part of a terminal.
Figure 4D:
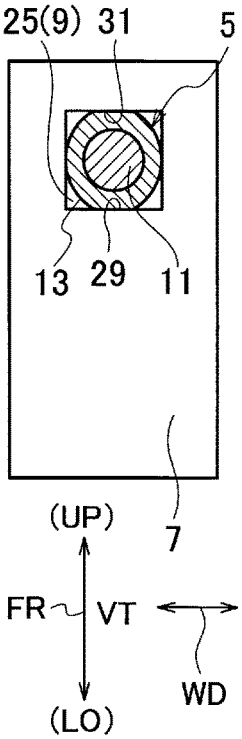
FIG. 4D is a diagram illustrating a state in which a conductor is bonded to a conductor bonding part and a sheath of the electric wire is urged by an inner wall defining the through hole and deformed from the state of FIG. 4C.

Further, as illustrated in FIGS. 4C and 4D, the through hole 25 may be formed in a rectangular shape (for example, a square shape).

FIG. 4C illustrates a state in which the electric wire 5 passes through the through hole 25 (a state of extending in a direction orthogonal to the sheet surface of FIG. 4C), and FIG. 4D illustrates a state in which the electric wire 5 passing through the through hole 25 is bent around the through hole 25 as illustrated in FIG. 2.

In FIG. 4D, two parts of the sheath 13 of the electric wire 5 are deformed by being urged by the front side portion 29 of the through hole 25 and the rear side portion 31 of the through hole 25.

In consideration of the Poisson's ratio of the sheath 13 and the like of the electric wire 5 in the state illustrated in FIG. 4D, the sheath 13 of the electric wire 5 is also subjected to the urging force from the through hole 25 at both left and right ends in FIG. 4D.

Further, the sheath 13 of the electric wire 5 is engaged with the sheath supporting part 9 (the inner wall of the terminal 3 defining the through hole 25) at a plurality of positions on the outer circumference thereof, and the engaged portion of the sheath 13 may not substantially move in the direction (radial direction) orthogonal to the longitudinal direction of the electric wire 5 with respect to the terminal 3. That is, it may be possible that the electric wire 5 can move only within the range of being elastically deformed.

Figure 4E:
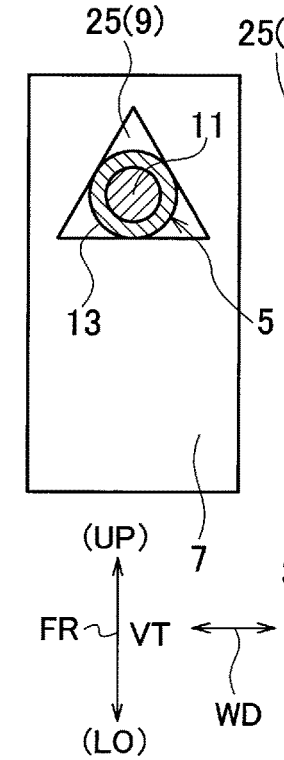
FIG. 4E is a diagram illustrating a state in which an electric wire pass through a through hole (through hole according to a modification) formed in a sheath supporting part of a terminal.
Figure 4F:
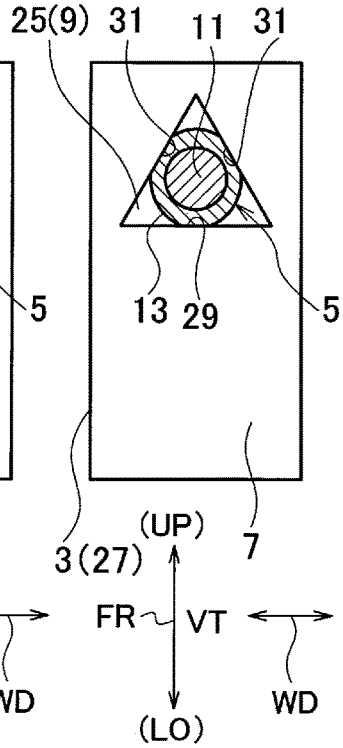
FIG. 4F is a diagram illustrating a state in which a conductor is bonded to a conductor bonding part and a sheath of the electric wire is urged by an inner wall defining the through hole and deformed from the state of FIG. 4E.

For example, as illustrated in FIGS. 4E and 4F, the through hole 25 may be formed in a triangular shape (for example, an equilateral triangular shape) FIG. 4E illustrates a state in which the electric wire 5 passes through the through hole 25 (a state of extending in a direction orthogonal to the sheet surface of FIG. 4E), and FIG. 4F illustrates a state in which the electric wire 5 passing through the through hole 25 is bent around the through hole 25 as illustrated in FIG. 2.

In FIG. 4F, three parts of the sheath 13 of the electric wire 5 are deformed by being urged by one front side portion 29 of the through hole 25 and two rear side portions 31 of the through hole 25.

Figure 4G:
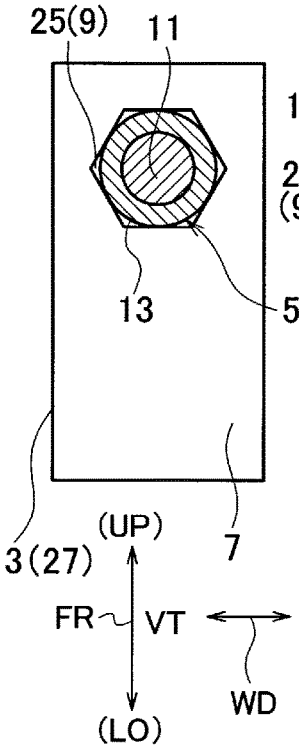
FIG. 4G is a diagram illustrating a state in which an electric wire pass through a through hole (through hole according to a modification) formed in a sheath supporting part of a terminal.
Figure 4H:
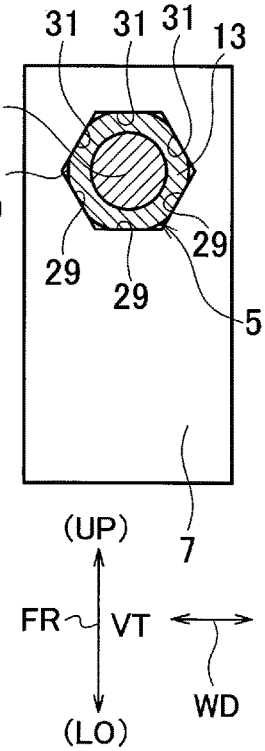
FIG. 4H is a diagram illustrating a state in which a conductor is bonded to a conductor bonding part and a sheath of the electric wire is urged by an inner wall defining the through hole and deformed from the state of FIG. 4G.

For example, as illustrated in FIGS. 4G and 4H, the through hole 25 may be formed in a polygonal shape (for example, a regular polygonal shape such as a hexagonal shape).

FIG. 4G illustrates a state in which the electric wire 5 passes through the through hole 25 (a state of extending in a direction orthogonal to the sheet surface of FIG. 4G), and FIG. 4H illustrates a state in which the electric wire 5 passing through the through hole 25 is bent around the through hole 25 as illustrated in FIG. 2.

In FIGS. 4G and 4H, six parts of the sheath 13 of the electric wire 5 are deformed by being urged by three front side portions 29 of the through hole 25 and three rear side portions 31 of the through hole 25.

Although only one through hole 25 is provided in the above description, a plurality of through holes 25 may be provided on the rear side of the flat plate-like portion 27 at a predetermined interval in the front rear direction FR, and the electric wire 5 may pass through the through holes 25 in order. In this case, the electric wire 5 bends each time it passes through each through hole 25 and therefore, extends from the upper side to the lower side of the flat plate-like portion 27 and also from the lower side to the upper side of the flat plate-like portion 27.

A method of manufacturing the terminal-equipped electric wire 1 will be described below. The terminal-equipped electric wire 1 is manufactured through a sheath supporting step and a conductor bonding step.

In the sheath supporting step, it is performed to allow the sheath supporting part 9 of the terminal 3 to be in a state where there is no permanent distortion with respect to the state when the terminal 3 is present alone, and support the sheath 13 of the electric wire 5 by the sheath supporting part 9 of the terminal 3.

In the conductor bonding step, an exposed part of the conductor 11A (exposed conductor) of the electric wire 5 is bonded to the conductor bonding part 7 of the terminal 3.

More specifically, the terminal-equipped electric wire 1 is manufactured by passing the electric wire 5 through the through hole 25 of the terminal 3 and bonding the conductor 11 of the electric wire 5 to the conductor bonding part 7.

In addition, the terminal-equipped electric wire 1 may be manufactured by bonding the conductor 11 of the electric wire 5 to the conductor bonding part 7, and then allowing the electric wire 5 to pass through the through hole 25 of the terminal 3.

Since the electric wire 5 is supported by the sheath supporting part 9 in the terminal-equipped electric wire 1, it is possible to prevent the conductor bonded portion 17 of the conductor 11 bonded to the terminal 3 from peeling off from the terminal 3. In addition, since the sheath supporting part 9 of the terminal 3 is in a state where there is no permanent distortion with respect to the state when the terminal 3 is present alone, it is possible to simplify the manufacturing process by eliminating a swaging step of the terminal 3 in order to hold the sheath 13 of the electric wire 5.

In addition, by preventing the bonded portion 17 of the electric wire 5 from peeling off from the terminal 3, the electric resistance between the conductor 11 and the terminal 3 of the electric wire 5 is prevented from rising.

Furthermore, since the sheath supporting part 9 supports the electric wire 5 with an urging force in the terminal-equipped electric wire 1, it is possible to more reliably hold the electric wire 5 by the sheath supporting part 9.

Since the sheath supporting part 9 is formed with the through hole 25 formed in a part of the terminal 3, the electric wire 5 passes through the through hole 25, the sheath 13 of the electric wire 5 is in contact with the inner wall of the terminal 3 defining the through hole 25, and the sheath 13 of the electric wire 5 is supported by the sheath supporting part 9 in the terminal-equipped electric wire 1, it is possible to simplify the configuration of the sheath supporting part 9 and at the same time, prevent the conductor bonded portion 17 of the conductor 11 bonded to the terminal 3 from peeling off from the terminal 3.

In the terminal-equipped electric wire 1, as illustrated in FIGS. 5A to 7B, the terminal 3 may be formed in a shape in which the flat plate-like material is bent at least one point.

In this regard, the conductor bonding part 7 may be formed in a first portion 35A of a plurality of portions (for example, a plurality of planar portions) 35 partitioned by the above-mentioned bent portion (a straight bending line formed by bending) 33.

In addition, a through hole (a through hole passing through the second portion 35B in the plate thickness direction) 25 constituting the sheath supporting part 9 may be formed in a second portion 35B of the portions (for example, a plurality of planar portions) 35 partitioned by the above-mentioned bent portion (a straight bending line formed by bending) 33.

A terminal-equipped electric wire 1 illustrated in FIGS. 5A and 5B will be described below in detail.

Figure 5A:
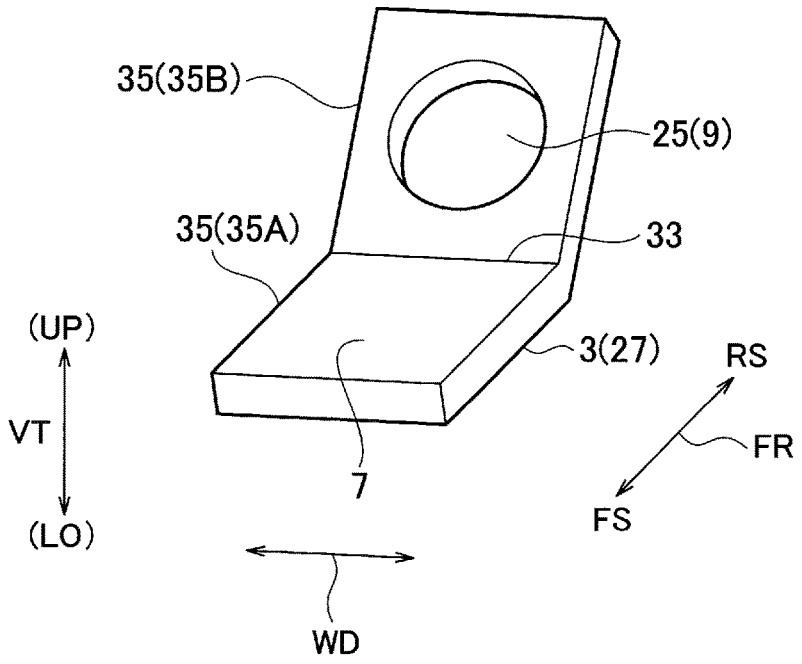
FIG. 5A is a perspective view of a terminal of a terminal-equipped electric wire according to a first modification.
Figure 5B:
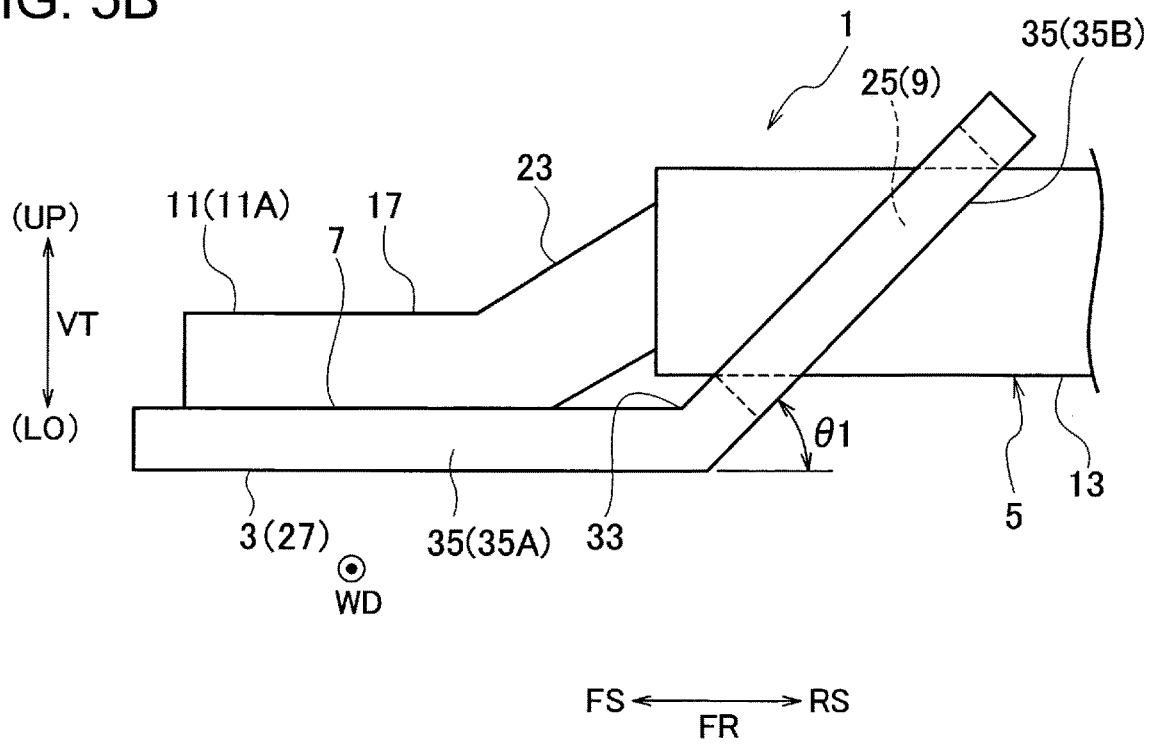
FIG. 5B is a side view of the terminal of the terminal-equipped electric wire according to the first modification.

The terminal 3 of the terminal-equipped electric wire 1 illustrated in FIGS. 5A and 5B has a structure in which a material formed in a flat plate shape (for example, a rectangular flat plate shape elongated in the front rear direction FR) is bent toward a surface (upwardly) at a predetermined angle (acute angle; for example, about 45°) at the position of the bending line 33 extending in the width direction WD in the middle portion in the front rear direction FR.

The sheath supporting part 9 is formed spaced apart from the bending line 33 in the portion 35B positioned on the rear side than the bending line 33. The through hole 25 constituting the sheath supporting part 9 is formed in a circular shape and obliquely passes through the portion 35B in the front rear direction FR.

The through hole 25 is spaced apart upwardly from the bending line 33 in the vertical direction VT, but may also be in contact with the bending line 33 in the vertical direction VT. The conductor bonding part 7 is formed in the portion 35A on the front side than the bending line 33.

In the electric wire 5, the exposed conductor 11A is bonded to the conductor bonding part 7 and extends from the bonded portion to the rear side. More specifically, the sheath 13 of the electric wire 5 covers the conductor 11 on the rear side from the position between the conductor bonding part 7 and the through hole 25, and the conductor 11 and the sheath 13 covering the conductor 11 pass through the through hole 25 from the front side to the rear side.

Therefore, the electric wire 5 (the conductor 11 and the sheath 13) is bent downward on the front side than the through hole 25 and extends to the rear side from the through hole 25 on the rear side than the through hole 25. In addition, a part of the sheath 13 of the electric wire 5, which is in contact with a part of the inner wall of the terminal 3 defining the through hole 25 is elastically deformed, and a part of the inner wall of the terminal 3 defining the through hole 25 urges the electric wire 5.

The through hole 25 will be further described. In the embodiment illustrated in FIGS. 5A and 5B, the through hole 25 has a circular shape (for example, a circular shape whose inner diameter is larger than the outer diameter of the electric wire 5) when viewed in the plate thickness direction of the portion 35B. The electric wire 5 passing through the through hole 25 extends linearly, for example, and is in contact with the lower end and the upper end of the through hole 25. When the through hole 25 illustrated in FIGS. 5A and 5B has an elliptical shape when viewed in the front rear direction FR.

Herein, the through hole 25 may have a circular shape (for example, a circular shape whose inner diameter is almost equal to the outer diameter of the electric wire 5) when viewed in the front rear direction FR. That is, the through hole 25 may have an elliptical shape when viewed in the plate thickness direction of the portion 35B. In this case, the shape of the through hole 25 (the shape passing through the portion 35B) is formed in the shape of an oblique cylinder with a low height (a small height dimension).

Next, a terminal-equipped electric wire 1 illustrated in FIGS. 6A and 6B will be described in detail.

Figure 6A:
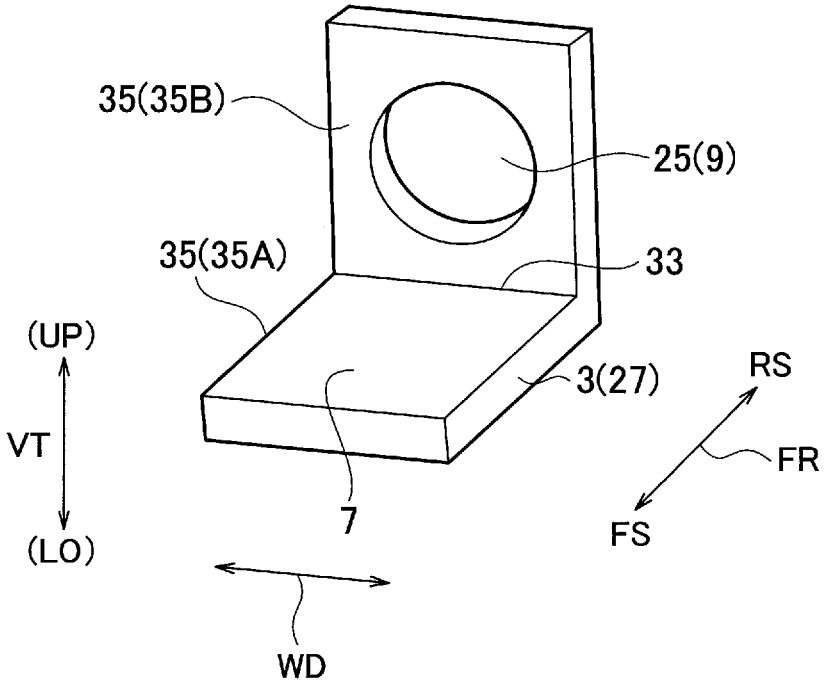
FIG. 6A is a perspective view of a terminal of a terminal-equipped electric wire according to a second modification.
Figure 6B:
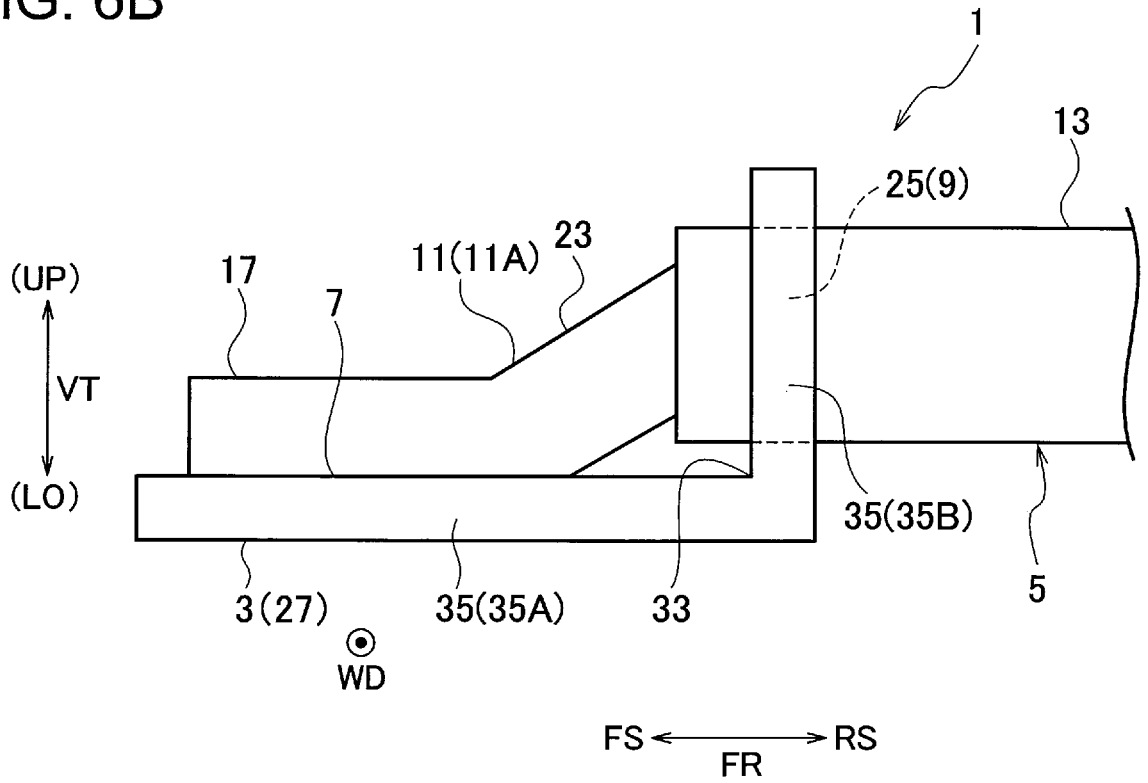
FIG. 6B is a side view of the terminal of the terminal-equipped electric wire according to the second modification.

The terminal 3 of the terminal-equipped electric wire 1 illustrated in FIGS. 6A and 6B has a structure in which a material formed in a flat plate shape (for example, a rectangular flat plate shape elongated in the front rear direction FR) is bent toward a surface (upwardly) at about 90° at the position of the bending line 33 extending in the width direction WD in the middle portion in the front rear direction FR.

The sheath supporting part 9 is formed spaced apart from the bending line 33 in the portion 35B positioned on the upper side than the bending line 33. The through hole 25 constituting the sheath supporting part 9 is formed in a circular shape and passes through the portion 35B in the front rear direction FR.

The through hole 25 is spaced apart upwardly from the bending line 33 in the vertical direction VT, but may also be in contact with the bending line 33 in the vertical direction VT. The conductor bonding part 7 is formed in the portion 35A on the front side than the bending line 33.

In the electric wire 5, the exposed conductor 11A is bonded to the conductor bonding part 7 and extends from the bonded portion to the rear side. More specifically, the sheath 13 of the electric wire 5 covers the conductor 11 on the rear side from the position between the conductor bonding part 7 and the through hole 25, and the conductor 11 and the sheath 13 covering the conductor 11 pass through the through hole 25 from the front side to the rear side.

Therefore, the electric wire 5 (the conductor 11 and the sheath 13) is bent downward on the front side than the through hole 25 and extends to the rear side from the through hole 25 on the rear side than the through hole 25. In addition, for example, as described above, a part of the sheath 13 of the electric wire 5, which is in contact with a part of the inner wall of the terminal 3 defining the through hole 25 is elastically deformed, and a part of the inner wall of the terminal 3 defining the through hole 25 urges the electric wire 5.

According to the terminal-equipped electric wire 1 illustrated in FIGS. 5A to 6B, the terminal 3 is formed in a shape in which a flat plate-like material is bent in at least one point and, in at least one portion 35B of portions 35 partitioned by the bent portions 33, the through hole 25 constituting the sheath supporting part 9 is formed, thereby reducing bending of the electric wire 5 in the sheath supporting part 9 or the vicinity thereof, compared to the case illustrated in FIG. 2 and the like.

A terminal-equipped electric wire 1 illustrated in FIGS. 7A and 7B will be described below in detail.

Figure 7A:
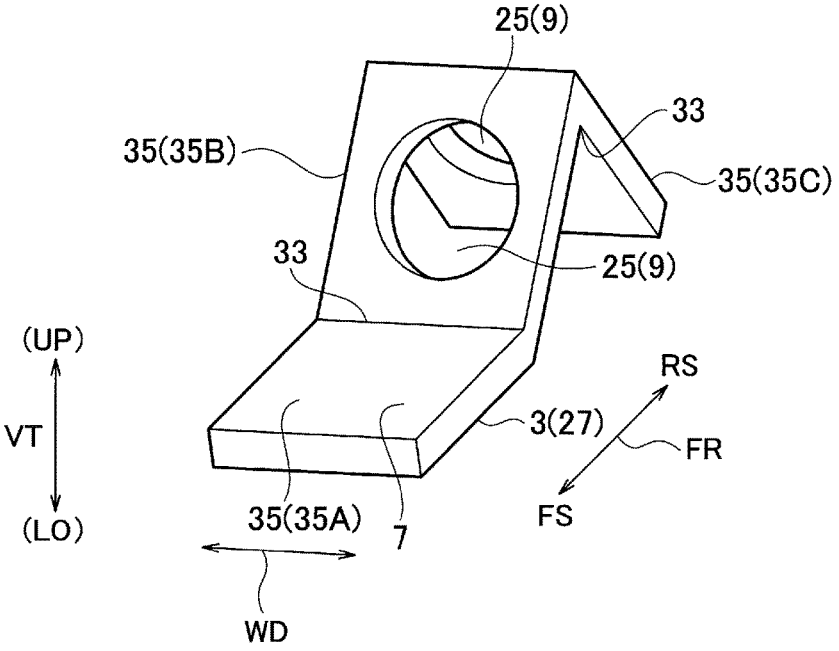
FIG. 7A is a perspective view of a terminal of a terminal-equipped electric wire according to a third modification.
Figure 7B:
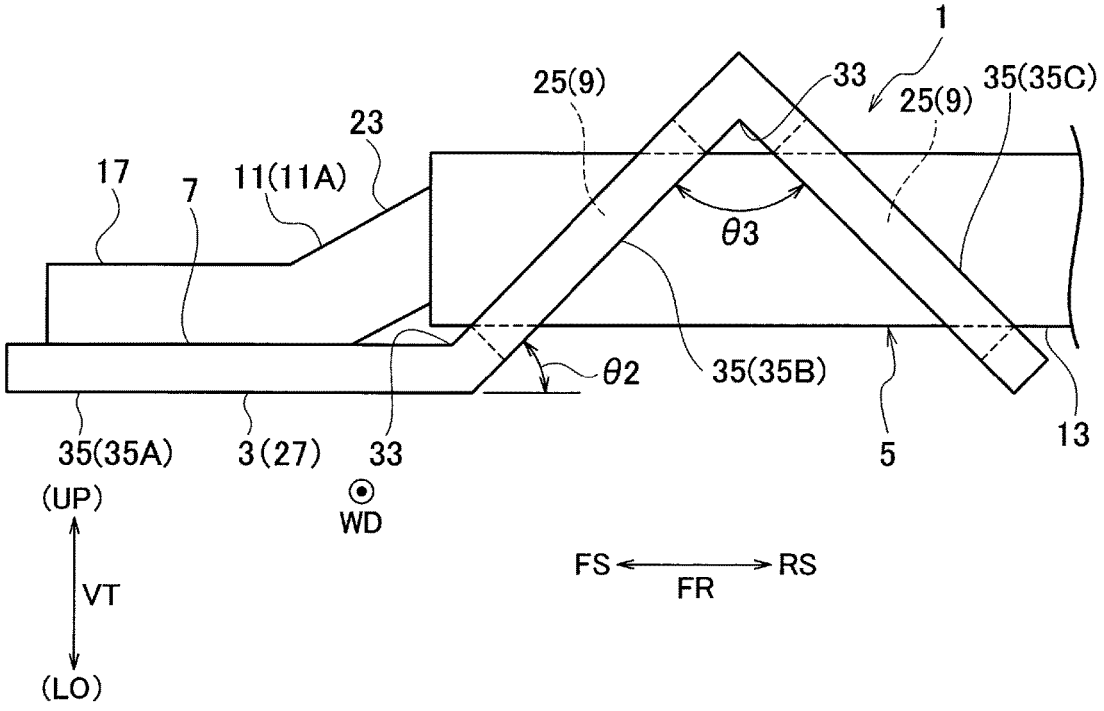
FIG. 7B is a side view of the terminal of the terminal-equipped electric wire according to the third modification.

The terminal 3 of the terminal-equipped electric wire 1 illustrated in FIGS. 7A and 7B has a shape obtained by bending a material formed in a flat plate shape at a plurality of points. For example, the material formed in a rectangular flat plate shape elongated in the front rear direction FR) is bent at the position of straight bending lines 33 (33A, 33B) extending in the width direction WD at a plurality of points in the middle portion in the front rear direction FR.

At the position of a front bending line 33A, the material is bent upward at a predetermined angle θ2 (acute angle; for example, about 45°). At the position of a rear bending line 33B, the material is bent downward at a predetermined angle θ3 (for example, about 90°).

The portions 35B and 35C on the rear side than the front bending line 33A are positioned on the upper side than the front bending line 33A in the vertical direction VT.

The through hole 25 constituting the sheath supporting part 9 is formed in all the other portions 35B and 35 C of the portions 35 partitioned by the bending lines 33.

More specifically, the sheath supporting part 9 is formed in the portion 35B positioned on the upper side than the bending line 33A and the portion 35C positioned on the lower side than the bending line 33B.

The through hole 25 constituting the sheath supporting part 9 will be described below in detail. In the embodiment illustrated in FIGS. 7A and 7B, one through hole 25 (through hole formed in the portion 35B) has a circular shape (for example, a circular shape whose inner diameter is larger than the outer diameter of the electric wire 5) when viewed in the plate thickness direction of the portion 35B. In addition, the other through hole 25 (through hole formed in the portion 35C) has also a circular shape (for example, a circular shape having the same diameter as the through hole 25 of the portion 35B) when viewed in the plate thickness direction of the portion 35C. The through hole 25 of the portion 35B and the through hole 25 of the portion 35C are aligned with each other in the vertical direction VT and the width direction WD.

The electric wire 5 passing through the through holes 25 extends linearly, for example, and is in contact with the lower ends and the upper ends of the through holes 25. When each of the through holes 25 illustrated in FIGS. 7A and 7B has an elliptical shape when viewed in the front rear direction FR.

Each of the through holes 25 is spaced apart upwardly from the bending line 33A in the vertical direction VT, but may also be in contact with the bending line 33A in the vertical direction VT. The conductor bonding part 7 is formed in the portion 35A on the front side than the bending line 33A.

Each of the through holes 25 may have a circular shape (for example, a circular shape whose inner diameter is almost equal to the outer diameter of the electric wire 5) when viewed in the front rear direction FR. That is, one through hole 25 may have an elliptical shape when viewed in the plate thickness direction of the portion 35B, and the other through hole 25 may have an elliptical shape when viewed in the plate thickness direction of the portion 35C. In this case, the shape of the through hole 25 (the shape passing through the portion 35B or the portion 35C) is formed in the shape of an oblique cylinder with a low height (a small height dimension).

In the electric wire 5, a part of the exposed conductor 11A (conductor bonded portion 17) is bonded to the conductor bonding part 7 and extends from the bonded portion to the rear side. More specifically, the sheath 13 of the electric wire 5 covers the conductor 11 on the rear side from the position between the conductor bonding part 7 and the through hole 25 formed in the portion 35B (the through hole on the front side), and the conductor 11 and the sheath 13 covering the conductor 11 pass through the through hole 25 from the front side to the rear side.

According to the terminal-equipped electric wire 1 illustrated in FIGS. 7A and 7B, each of the through holes 25 constituting the sheath supporting part 9 is formed in all the other portions 35B and 35 C (the portions other than the conductor bonding part 7 to which the conductor bonded portion 17 is bonded) of the portions 35 partitioned by the bent portions 33. Therefore, the sheath 13 of the electric wire 5 is supported by the sheath supporting part 9 at a plurality of positions in the longitudinal direction of the electric wire 5, so that the sheath 13 of the electric wire 5 is more reliably held.

Also, in the terminal-equipped electric wire 1 illustrated in FIGS. 7A and 7B, the position of the through hole 25 of the portion 35C may be deviated in the vertical direction VT with respect to the position of the through hole 25 of the portion 35B.

On the other hand, in the terminal-equipped electric wire 1, as illustrated in FIG. 8, FIGS. 9A to 9C, and FIG. 10, FIG. 11, FIGS. 12A to 12D, and FIGS. 13, or FIG. 14, FIGS. 15A to 15C, and FIG. 16, the terminal 3 may have a shape with a flat plate-like terminal body 37 and a protruding portion 39 protruding from a plane of the terminal body 37 in the plate thickness direction (an upper surface in the vertical direction VT).

In this case, the conductor bonding part 7 is formed a part of the flat plate-like terminal body 37, and the conductor 11 of the electric wire 5 is bonded to a part of the flat plate-like terminal body 37 on one surface (upper surface) in the plate thickness direction.

The sheath supporting part 9 is formed in an annular shape along with the protruding portion 39 and another portion of the flat plate-like terminal body 37. Then, the electric wire 5 is inserted into the annular sheath supporting part 9, so that the sheath 13 of the electric wire 5 contacts at least the protruding portion 39 and therefore, the sheath 13 of the electric wire 5 is supported by the sheath supporting part 9.

As illustrated in FIG. 8 or FIGS. 9A to 9C, the sheath supporting part 9 does not need to be a perfect ring, and a part of the sheath supporting part 9 may be omitted. The protruding portion 39 is formed by plastically deforming a part of a flat plate-like material, for example.

A terminal-equipped electric wire 1 illustrated in FIGS. 8 to 10 will be described below in detail.

Figure 8:
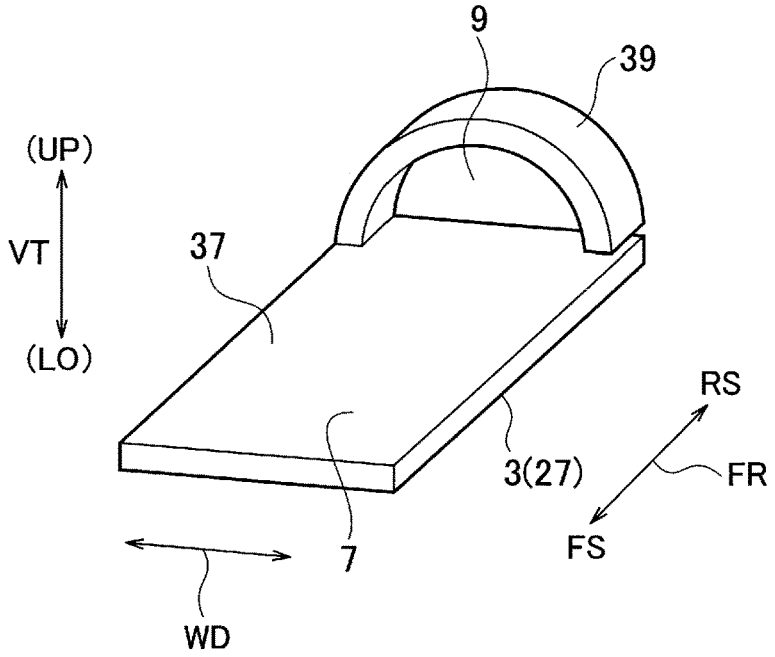
FIG. 8 is a perspective view of a terminal of a terminal-equipped electric wire according to a fourth modification.
Figure 9C:
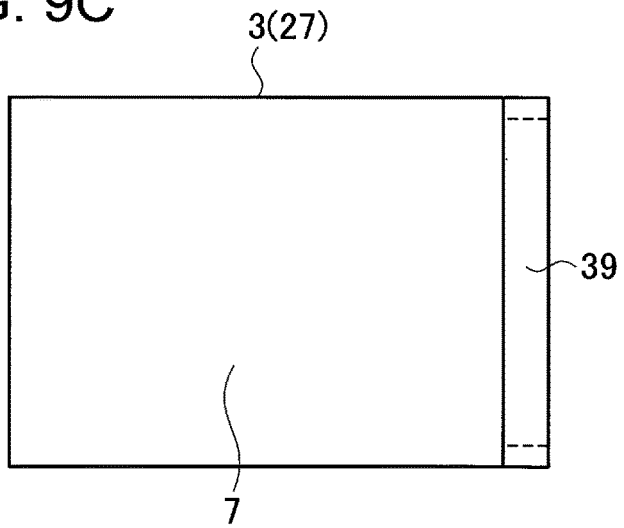
FIG. 9C is a plan view of the terminal illustrated in FIG. 8.
Figure 9B:
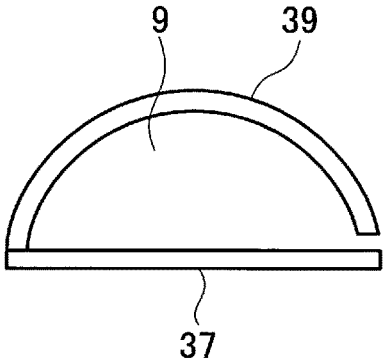
FIG. 9B is a front view of the terminal illustrated in FIG. 8.
Figure 9A:
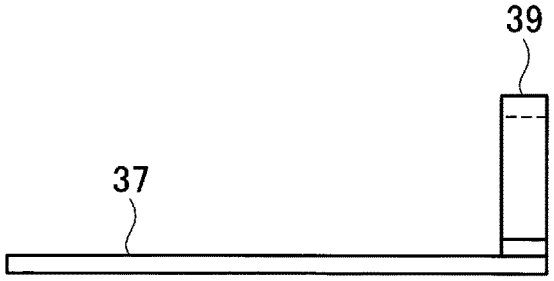
FIG. 9A is a side view of the terminal illustrated in FIG. 8.
Figure 10:
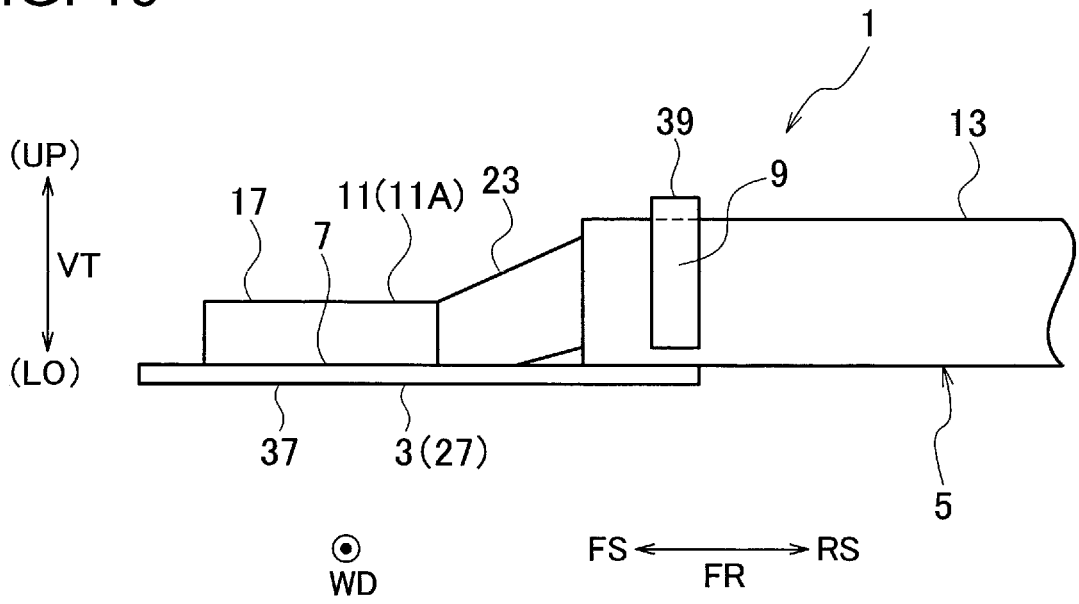
FIG. 10 is a side view of a terminal-equipped electric wire using the terminal illustrated in FIG. 8 or 9.

The terminal 3 of the terminal-equipped electric wire 1 illustrated in FIGS. 8 to 10 is formed in a rectangular flat plate shape in which the terminal body 37 is long in the front rear direction FR and the protruding portion 39 protrudes upward from the rear end of the terminal body 37.

When the terminal 3 of the terminal-equipped electric wire 1 illustrated in FIGS. 8 to 10 is viewed in the front rear direction FR, the protruding portion 39 has a semi-elliptic arc shape (semicircular arc shape of an ellipse in which the minor axis extends in the vertical direction VT and the major axis extends in the width direction WD), and one end thereof is connected to one end of the terminal body 37 in the width direction WD and the other end is spaced slightly apart from the other end of the terminal body 37 in the width direction WD. Alternatively, the other end may be attached to the other end of the terminal body 37 in the width direction WD.

The exposed conductor 11A of the electric wire 5 is bonded to the conductor bonding part 7 (the portion of the terminal body 37 positioned on the front side than the protruding portion 39) and extends to the rear side from the bonded portion. More specifically, the sheath 13 of the electric wire 5 covers the conductor 11 on the rear side from the position between the conductor bonding part 7 and the protruding portion 39, and the conductor 11 and the sheath 13 covering the conductor 11 pass through the protruding portion 39 from the front side to the rear side.

The sheath 13 of the electric wire 5 contacting the terminal body 37 or a part of the protruding portion 39 is elastically deformed so that the terminal body 37 or a part of the protruding portion 39 urges the electric wire 5.

Next, a terminal-equipped electric wire 1 illustrated in FIGS. 11 to 13 will be described in detail.

Figure 11:
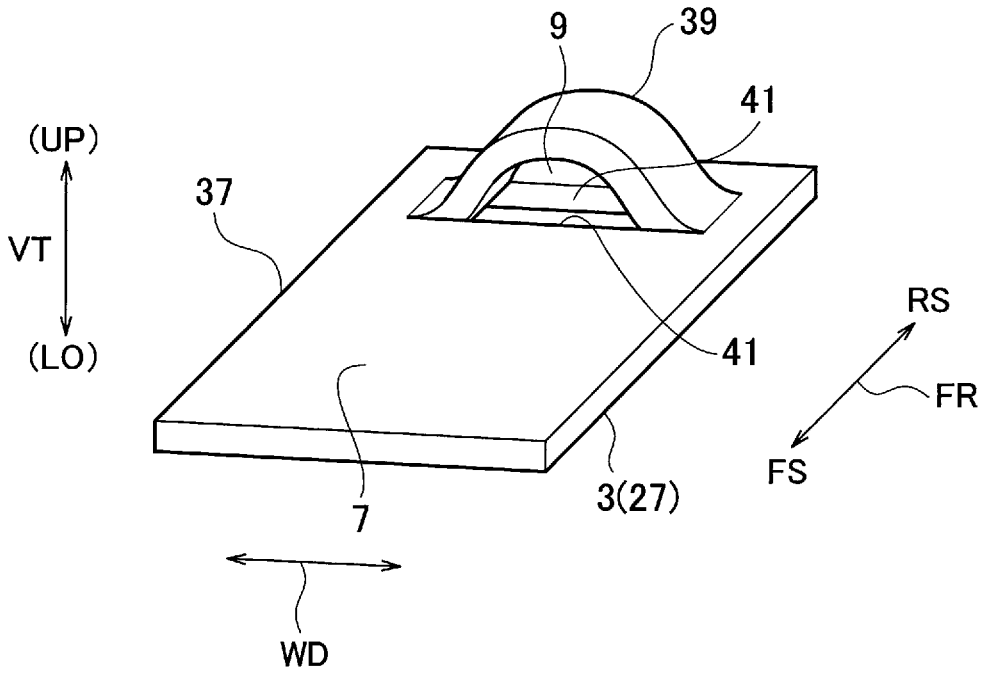
FIG. 11 is a perspective view of a terminal of a terminal-equipped electric wire according to a fifth modification.
Figure 12D:
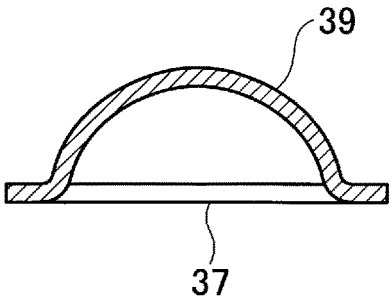
FIG. 12D is a cross-sectional view taken along XIID-XIID of FIG. 12A.
Figure 12C:
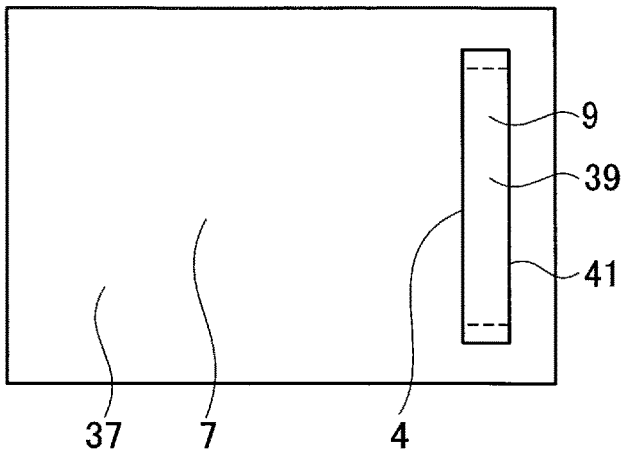
FIG. 12C is a plan view of the terminal illustrated in FIG. 11.
Figure 12B:
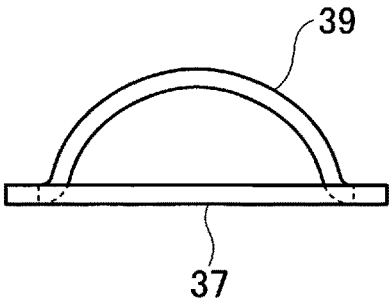
FIG. 12B is a front view of the terminal illustrated in FIG. 11.
Figure 12A:
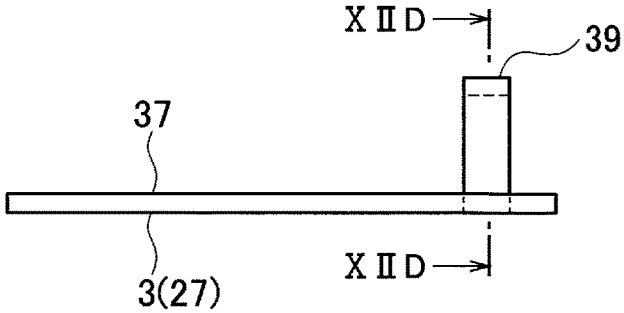
FIG. 12A is a side view of the terminal illustrated in FIG. 11.
Figure 13:
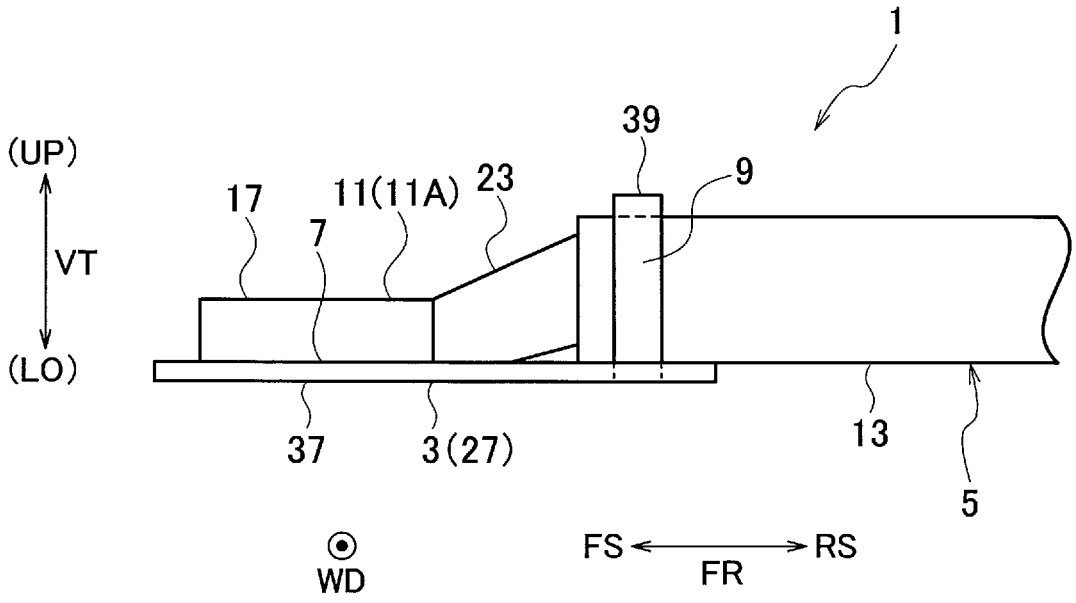
FIG. 13 is a side view of a terminal-equipped electric wire according to a modification using the terminal illustrated in FIG. 11 or 12.

The terminal 3 of the terminal-equipped electric wire 1 illustrated in FIGS. 11 to 13 is formed in a rectangular flat plate shape in which the terminal body 37 is long in the front rear direction FR and the protruding portion 39 protrudes upward from the rear end of the terminal body 37.

More specifically, two slits 41 are formed at a rear end of a flat plate-like material, and a protruding portion 39 is formed by plastic-deforming a portion between the slits 41 upward.

The slit 41 extends from the vicinity of one end of the material (the terminal body 37) to the vicinity of the other end in the width direction WD, passes through the material in the vertical direction VT (the plate thickness direction of the material), and is positioned at the rear end of the material in the front rear direction FR. At the same time, the front slit 41 and the rear slit 41 are spaced apart from each other by a small distance in the front rear direction FR.

When the terminal 3 of the terminal-equipped electric wire 1 illustrated in FIGS. 11 to 13 is viewed in the front rear direction FR, the protruding portion 39 has a semi-elliptic arc shape (a semicircular arc shape of an ellipse in which the minor axis extends in the vertical direction VT and the major axis extends in the width direction WD), and one end thereof is connected to one end of the terminal body 37 in the width direction WD and the other end is connected to the other end of the terminal body 37 in the width direction WD.

The exposed conductor 11A of the electric wire 5 is bonded to the conductor bonding part 7 (the portion of the terminal body 37 positioned on the front side than the protruding portion 39) and extends to the rear side from the bonded portion. More specifically, the sheath 13 of the electric wire 5 covers the conductor 11 on the rear side from the position between the conductor bonding part 7 and the protruding portion 39, and the conductor 11 and the sheath 13 covering the conductor 11 pass through the protruding portion 39 from the front side to the rear side.

The sheath 13 of the electric wire 5 contacting the terminal body 37 or a part of the protruding portion 39 is elastically deformed so that the terminal body 37 or a part of the protruding portion 39 urges the electric wire 5.

According to the terminal-equipped electric wire 1 illustrated in FIGS. 11 to 13, the terminal 3 includes a flat plate-like terminal body 37 and a protruding portion 39 protruding from a plane of the terminal body 37 in the plate thickness direction, the sheath supporting part 9 is formed in an annular shape along with the protruding portion 39 and the terminal body 37, and the electric wire 5 is inserted into the annular sheath supporting part 9, so that the sheath 13 of the electric wire 5 contacts at least the protruding portion 39 and therefore, the sheath 13 of the electric wire 5 is supported by the sheath supporting part 9. Therefore, it is possible to reduce bending of the electric wire 5 in the sheath supporting part 9 or the vicinity thereof.

In addition, since both ends of the elliptical arc of the protruding portion 39 are supported by the terminal body 37, the rigidity of the sheath supporting part 9 increases, thereby reliably preventing the conductor bonded portion 17 of the conductor 11 bonded to the terminal 3 from peeling off from the terminal 3.

Next, a terminal-equipped electric wire 1 illustrated in FIGS. 14 to 16 will be described in detail.

Figure 14:
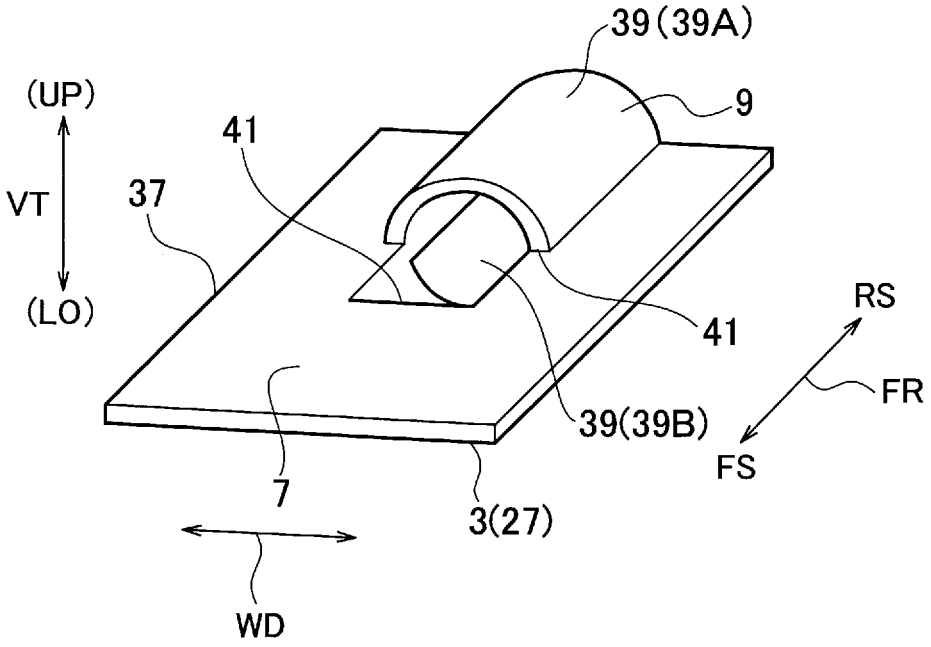
FIG. 14 is a perspective view of a terminal of a terminal-equipped electric wire according to a sixth modification.
Figure 15C:
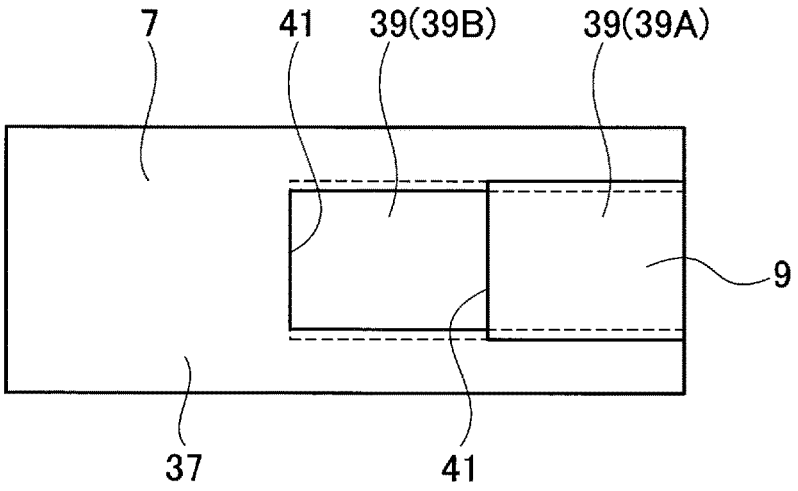
FIG. 15C is a plan view of the terminal illustrated in FIG. 14.
Figure 15A:
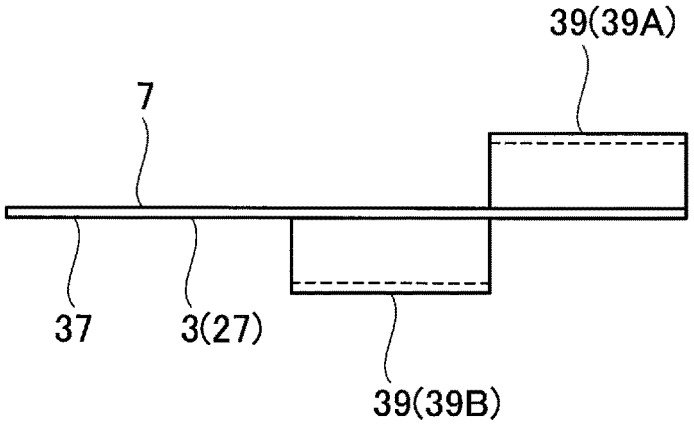
FIG. 15A is a side view of the terminal illustrated in FIG. 14.
Figure 15B:
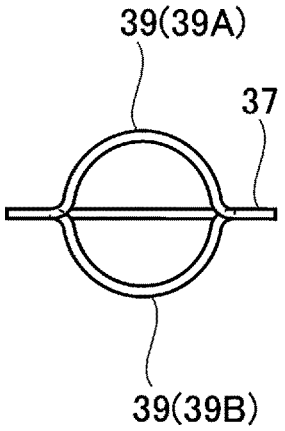
FIG. 15B is a front view of the terminal illustrated in FIG. 14.
Figure 16:
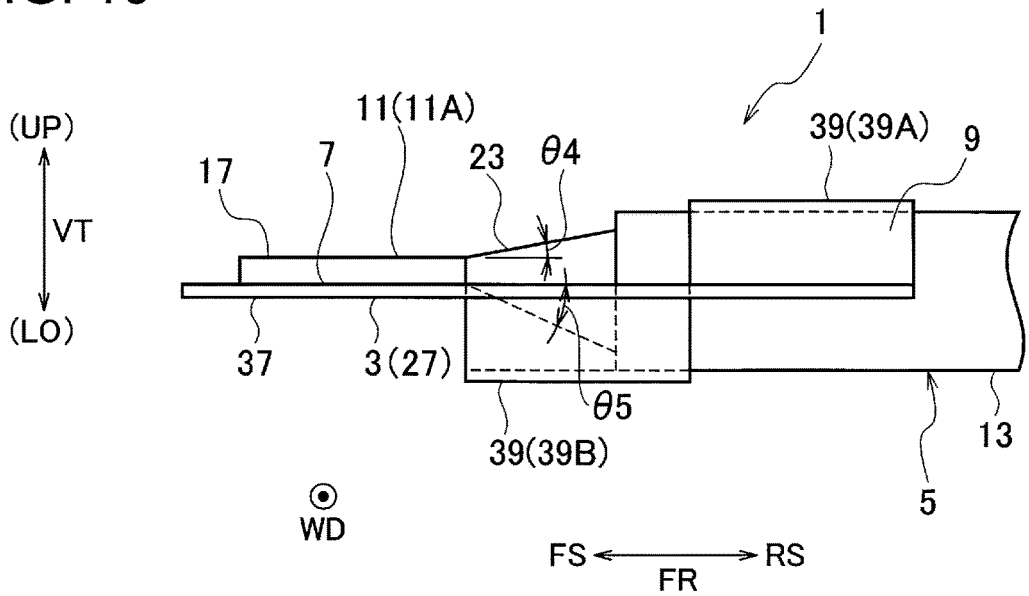
FIG. 16 is a side view of a terminal-equipped electric wire according to a modification using the terminal illustrated in FIG. 14 or 15.

The terminal 3 of the terminal-equipped electric wire 1 illustrated in FIGS. 14 to 16 includes a flat plate-like terminal body 37, a first protruding portion 39A protruding from a plane (upper surface) of the terminal body 37 on one side in the plate thickness direction in a part of the terminal body 37 and a second protruding portion 39B protruding from a plane (lower surface) of the terminal body 37 on the other side in the plate thickness direction in the other part of the terminal body 37.

The conductor bonding part 7 of the terminal 3 of the terminal-equipped electric wire 1 illustrated in FIGS. 14 to 16 is formed in another part of the flat plate-like terminal body 37.

In the terminal 3 of the terminal-equipped electric wire 1 illustrated in FIGS. 14 to 16, the first protruding portion 39A, the second protruding portion 39B, the conductor bonding part 7 are arranged linearly in the order thereof from the rear side to the front side in the longitudinal direction of the electric wire 5 (in the front rear direction FR).

In the terminal 3 of the terminal-equipped electric wire 1 illustrated in FIGS. 14 to 16, the sheath supporting part 9 is composed of the first protruding portion 39A and the second protruding portion 39B, and the electric wire 5 is in contact with the first protruding portion 39A and the second protruding portion 39B, thereby being supported by the sheath supporting part 9.

More specifically, two slits 41, which extend in the width direction WD and are spaced apart from each other a predetermined distance in the front rear direction FR, are formed at the rear end of a rectangular flat plate-like material which is long in the front rear direction FR, a part between the two slits 41 is plastically deformed to protrude toward one side in the plate thickness direction of the material, and a part on the rear side than the rear slit of the two slits 41 is plastically deformed to protrude toward the other side in the plate thickness direction of the material, thereby forming the protruding portion 39 (39A and 39B).

The slit 41 extends from the vicinity of one end of the material to the vicinity of the other end in the width direction WD, passes through the material in the vertical direction VT (the thickness direction of the material).

When the terminal 3 of the terminal-equipped electric wire 1 illustrated in FIGS. 14 to 16 is viewed in the front rear direction FR, the first protruding portion 39A has a semi-elliptic arc shape, and one end thereof is connected to one end of the terminal body 37 in the width direction WD and the other end is connected to the other end of the terminal body 37 in the width direction WD. Furthermore, the second protruding portion 39B has a semi-elliptic arc shape, and one end thereof is connected to one end of the terminal body 37 in the width direction WD and the other end is connected to the other end of the terminal body 37 in the width direction WD.

In the terminal-equipped electric wire 1 illustrated in FIGS. 14 to 16, the first protruding portion 39A protrudes toward the side (upper side) to which the conductor 11 of the electric wire 5 is bonded, and the second protruding portion 39B protrudes toward on the opposite side (lower side) to the side to which the conductor 11 of the electric wire 5 is bonded.

More specifically, the exposed conductor 11A of the electric wire 5 is bonded to the conductor bonding part 7 (the portion of the terminal body 37 positioned on the front side than the second protruding portion 39B) and extends from the bonded portion to the rear side.

Furthermore, the sheath 13 of the electric wire 5 covers the conductor 11 on the rear side from the position of the middle portion of the second protruding portion 39B in the front rear direction FR, and the conductor 11 and the sheath 13 covering the conductor 11 pass through the protruding portions 39 (39B, 39A) from the front side to the rear side.

For example, the sheath 13 of the electric wire 5 contacting the protruding portion 39 is elastically deformed by being urged by the protruding portion 39.

According to the terminal-equipped electric wire 1 illustrated in FIGS. 14 to 16, as described above, the terminal 3 includes a first protruding portion 39A protruding from a plane of the terminal body 37 on one side in the plate thickness direction in a part of the terminal body 37 and a second protruding portion 39B protruding from a plane of the terminal body 37 on the other side in the plate thickness direction in the other part of the terminal body 37, the first protruding portion 39A, the second protruding portion 39B, the conductor bonding part 7 are arranged linearly in the order thereof from the rear side to the front side in the longitudinal direction of the electric wire 5, the sheath supporting part 9 is composed of the first protruding portion 39A and the second protruding portion 39B, and the electric wire 5 contacts the first protruding portion 39A and the second protruding portion 39B, thereby being supported by the sheath supporting part 9.

Therefore, it is possible to reliably prevent the conductor bonded portion 17 from peeling off from the terminal 3 even when a moment is applied to peel the conductor bonded portion 17 of the electric wire 5 bonded to the terminal 3 from the terminal 3.

On the other hand, in the terminal-equipped electric wire 1 illustrated in FIG. 16, the protruding amount of the first protruding portion 39A in the vertical direction VT is equal to the protruding amount of the second protruding portion 39B in the vertical direction VT. Therefore, the intersection angle θ4 of the upper surface of the middle portion 23 of the electric wire 5 with respect to the front rear direction FR is different from the intersection angle θ5 of the lower surface of the middle portion 23 of the electric wire 5 with respect to the front rear direction FR.

Figure 17:
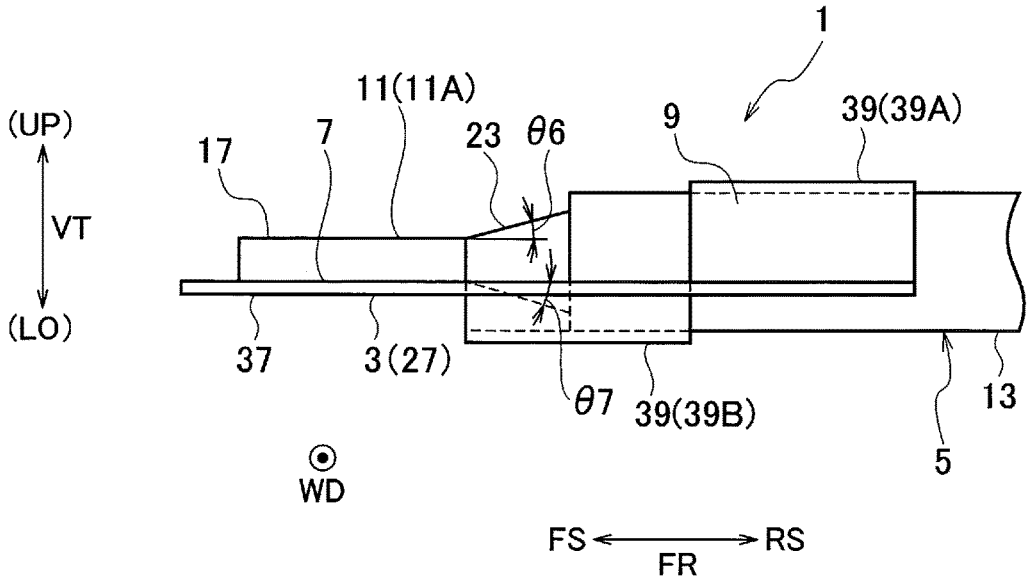
FIG. 17 is a side view of a modification of the terminal-equipped electric wire illustrated in FIG. 16.
Figure 18C:
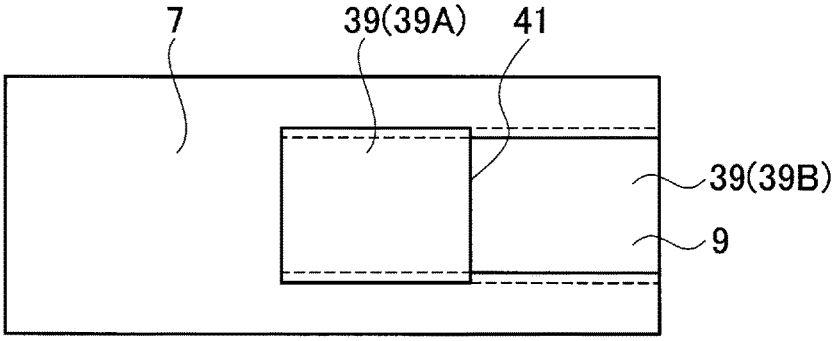
FIG. 18C is a plan view of the terminal according to the seventh modification.
Figure 18A:
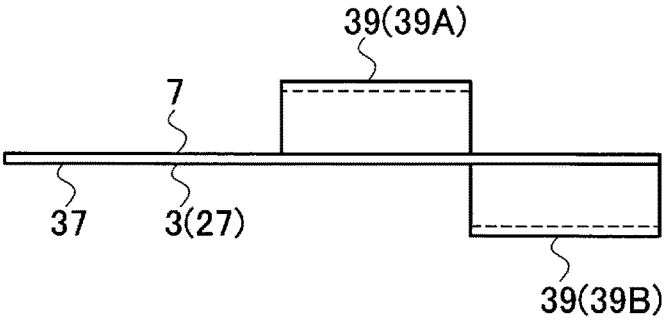
FIG. 18A is a side view of a terminal according to a seventh modification.
Figure 18B:
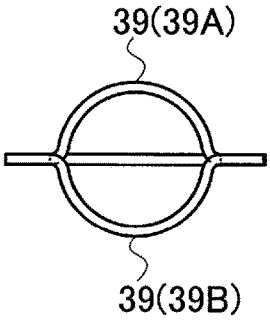
FIG. 18B is a front view of the terminal according to the seventh modification.

In this regard, the protruding amount of the first protruding portion 39A and the protruding amount of the second protruding portion 39B may be different from each other like the terminal-equipped electric wire 1 illustrated in FIG. 17. For example, the protruding amount of the first protruding portion 39A may be larger than the protruding amount of the second protruding portion 39B.

The intersection angle θ6 of the upper surface of the middle portion 23 with respect to the front rear direction FR and the intersection angle θ7 of the lower surface of the middle portion 23 with respect to the front rear direction FR may be equal to each other.

Therefore, a value of the internal stress occurring in the middle portion 23 of the electric wire 5 when the conductor 11 of the electric wire 5 is bonded to the conductor bonding part 7 may be dispersed to the upper side and the lower side, thereby being reduced.

In the terminal-equipped electric wire 1 illustrated in FIGS. 11 to 17, the protruding portion 39 is formed by protruding a part of the rectangular material, thereby minimizing occurrence of end material in the case of manufacturing the terminal 3.

In the terminal 3 of the terminal-equipped electric wire 1 illustrated in FIGS. 14 to 17, the first protruding portion 39A, the second protruding portion 39B, the conductor bonding part 7 are arranged linearly in the order thereof from the rear side to the front side in the longitudinal direction of the electric wire 5 (in the front rear direction FR). However, the arrangement positions of the first protruding portion 39A and the second protruding portion 39B may be changed.

In other words, as illustrated in FIGS. 18A to 18C, and 19, the second protruding portion 39B, the first protruding portion 39A, the conductor bonding part 7 may be arranged linearly in their order from the rear side to the front side in the longitudinal direction of the electric wire 5 (in the front rear direction FR).

Figure 19:
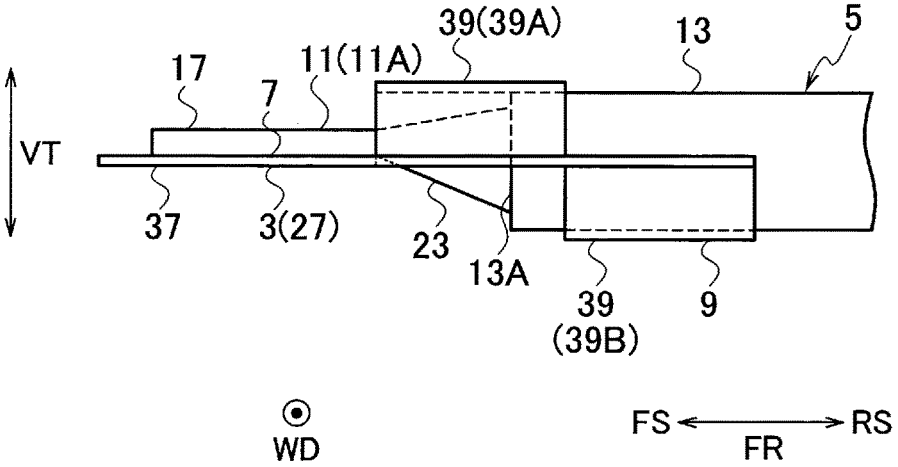
FIG. 19 is a side view of a terminal-equipped electric wire according to a modification using the terminal illustrated in FIG. 18.
Figure 20C:
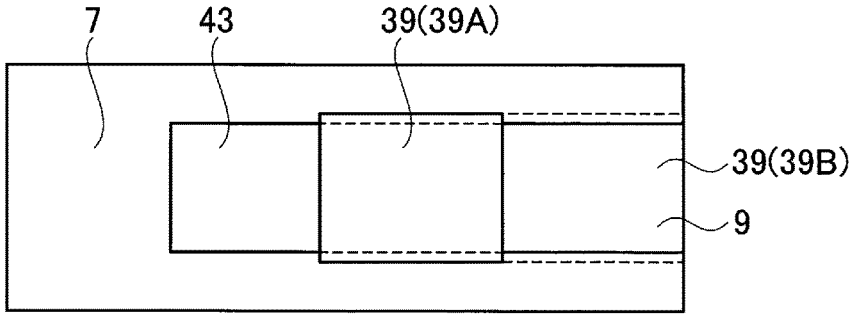
FIG. 20C is a plan view of the terminal according to the eighth modification.
Figure 20A:
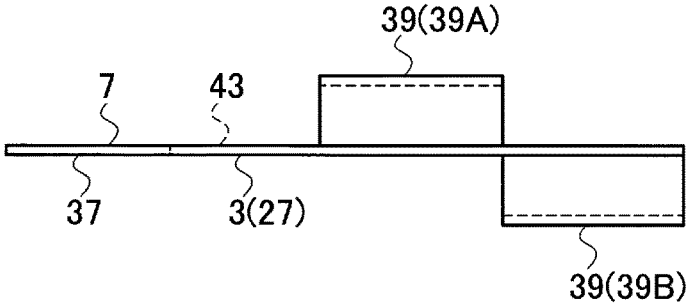
FIG. 20A is a side view of a terminal according to an eighth modification.
Figure 20B:
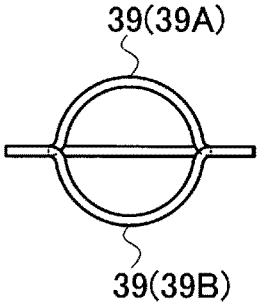
FIG. 20B is a front view of the terminal according to the eighth modification.

In the terminal-equipped electric wire 1 illustrated in FIG. 19, even when the peeling force (force for pulling the conductor 11 of the electric wire 5 upward) is applied to a bonded area between the conductor 11 and the conductor bonding part 7, it is possible to effectively prevent the conductor 11 from peeling off from the terminal 3 in the bonded area since the first protruding portion 39A is adjacent to the conductor bonding part 7.

Figure 21:
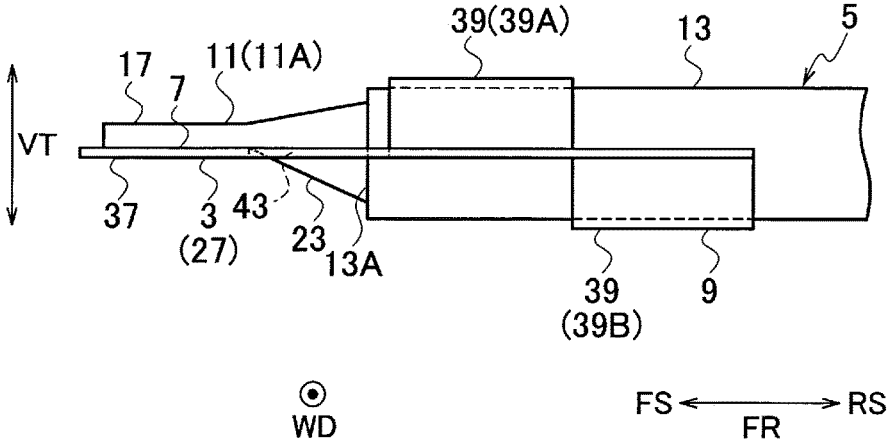
FIG. 21 is a view of a terminal-equipped electric wire according to a modification using the terminal illustrated in FIG. 20.
Figure 22A:
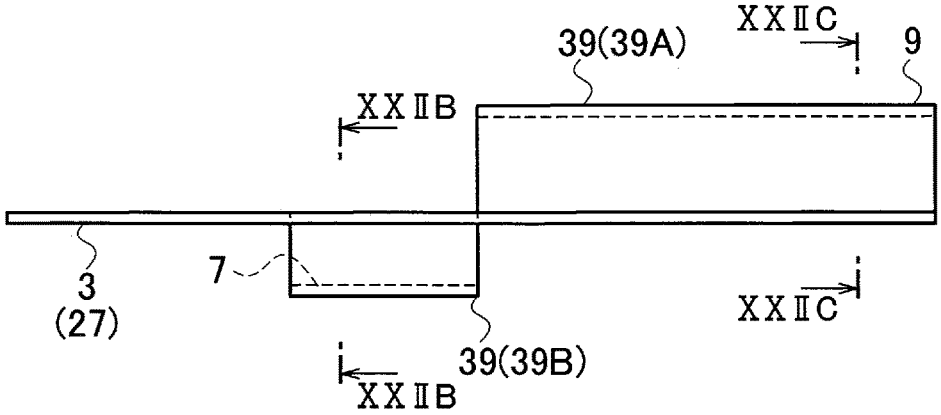
FIG. 22A is a side view of a terminal according to a ninth modification.
Figure 22B:
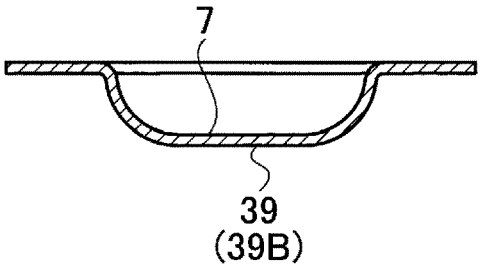
FIG. 22B is a cross-sectional view taken along XXIIB-XXIIB of FIG. 22A.
Figure 22C:
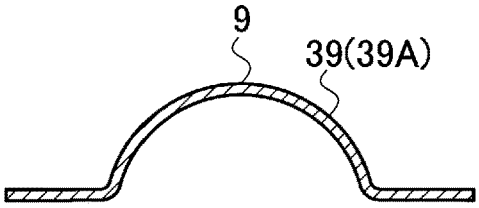
FIG. 22C is a cross-sectional view taken along XXIIC-XXIIC of FIG. 22A.
Figure 23:
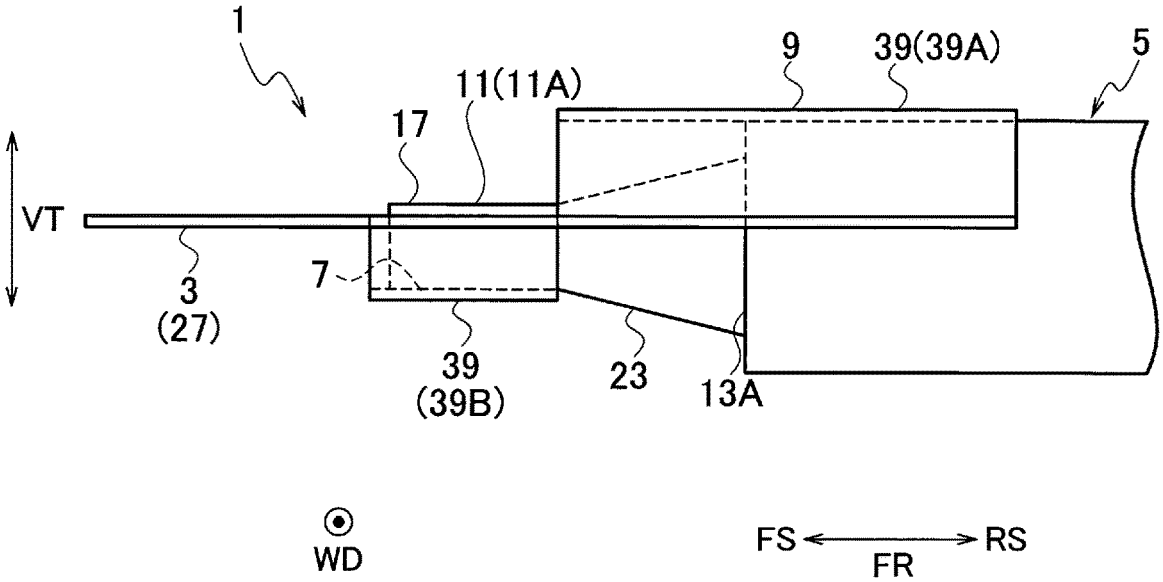
FIG. 23 is a side view of a terminal-equipped electric wire according to a modification using the terminal illustrated in FIG. 22.

Although the front end 13A of the sheath 13 of the electric wire 5 is positioned in the middle of the first protruding portion 39A in the front rear direction FR in the terminal 3 of the terminal-equipped electric wire 1 illustrated in FIG. 19, as illustrated in FIG. 21, the front end 13A of the sheath 13 of the electric wire 5 may be positioned on the front side than the first protruding portion 39A in the front rear direction FR.

In this case, a through hole 43 is provided in the terminal 3 in order to avoid interference between the middle portion 23 of the conductor 11 and the terminal 3 (see FIGS. 20A to 20C and FIG. 21). The through hole 43 passes through a thickness part of the portion of the terminal 3 in the plate thickness direction thereof, and the second protruding portion 39B, the first protruding portion 39A, the through hole 43, and the conductor bonding part 7 are arranged linearly in their order from the rear side to the front side in the longitudinal direction of the electric wire 5 (the front rear direction FR) in the front rear direction FR.

In addition, as illustrated in FIGS. 22A to 22C and FIG. 23, the conductor bonding part 7 may be provided in the second protruding portion 39B.

In this case, the front end 13A of the sheath 13 of the electric wire 5 is positioned in the middle portion of the first protruding portion 38A in the front rear direction FR, and the middle portion 23 of the conductor 11 is positioned at the position on the front side of the first protruding portion 38A in the front rear direction FR. In addition, a flat plate-like bottom surface portion in which the conductor bonding part 7 is formed is formed in the second protruding portion 38B. When viewed in the front rear direction FR, the second protruding portion 38B (conductor bonding part 7) may be formed in an arc shape.

Although one first protruding portion 39A and one second protruding portion 39B come into contact with each other in the front rear direction FR in each of the terminals 3 described above, one first protruding portion 39A and one second protruding portion 39B may be separated from each other.

A plurality of first protruding portions 39A and a plurality of second protruding portions 39B may alternatively be provided in the front rear direction FR.

In the above description, the description is given by taking, examples, a case in which the shape of the cross section of the portion of the electric wire 5 excluding the conductor bonded portion 17 or the middle portion 23, or the conductor 11 (cross-sectional taken along the plane orthogonal to the longitudinal direction of the electric wire 5) is a circular shape. However, the shape of the cross section of the portion of the electric wire 5 excluding the conductor bonded portion 17 or the middle portion 23, or the conductor 11 may have a shape other than a circular shape, such as an elliptical shape or a rectangular shape.

In addition, the contents described above may be grasped as an ultrasonic bonding method of conductors of electric wires. That is, in the ultrasonic bonding method of the conductor of the electric wire, which ultrasonically bonds the conductor 11 constituted by the plurality of strands 15 of the electric wire 5, to the conductor bonding part 7 of the terminal 3, the ultrasonic bonding step of performing ultrasonic bonding may be grasped as an ultrasonic bonding method for preventing the entire plurality of the strands 15 from being pulled out from the horn 19 in the width direction WD, bringing the horn 19 into contact with the conductor 11, clamping the conductor 11 and the conductor bonding part 7 of the terminal 3 between the anvil 21 and the horn 19 and ultrasonically vibrating the horn 19.

In this case, the ultrasonic bonding step may include a bonded portion forming step of bonding a plurality of strands 15 of the electric wire 5 to each other to form a bonded portion (conductor bonded portion) 17, and a bonded portion fixing step of integrally fixing (securing) the conductor bonded portion 17 formed in the bonded portion forming step in the conductor bonding part 7 of the terminal 3.

More specifically, in the bonded portion forming step, only the conductor 11 is clamped between the anvil 21 and the horn 19, and the horn 19 is ultrasonically vibrated to form the conductor bonded portion 17.

In the bonded portion fixing step, the conductor bonded portion 17 formed in the bonded portion forming step and the conductor bonding part 7 of the terminal 3 are clamped between the anvil 21 and the horn 19, and the horn 19 is ultrasonically vibrated to integrally fix the bonded portion 17 of the conductor 11 in the conductor bonding part 7 of the terminal 3.

When being clamped between the anvil 21 and the horn 19 in the bonded portion fixing step, the conductor bonded portion 17 is positioned on the upper side and the conductor bonding part 7 of the terminal 3 is positioned on the lower side, so that the conductor bonded portion 17 and the conductor bonding part 7 are overlapped in the vertical direction VT. Then, the anvil 21 is positioned under the conductor bonding part 7 to be in contact with the conductor bonding part 7, and the horn 19 is positioned on the conductor 11 (conductor bonded portion 17) to be in contact with the conductor 11.

In this way, after the conductor bonded portion 17 is formed in the bonded portion forming step, the conductor bonded portion 17 is fixed in the conductor bonding part 7 of the terminal 3 in the bonded portion fixing step, thereby reliably performing bonding of the electric wire 5 to the terminal 3.

For example, in the bonded portion forming step, the strands 15 are bonded to each other and the conductor bonded portion 17 becomes a single wire. Then, in the bonded portion fixing step, the conductor bonded portion 17 which is a single wire is fixed in the conductor bonding part 7 of the terminal 3. Thus, the strands 15 are prevented from being broken, and the terminal 3 of the conductor 11 of the electric wire 5 can be properly bonded to the conductor bonding part 7.

In the above description, after only the conductor 11 is clamped between the anvil 21 and the horn 19 and the conductor bonded portion 17 is formed in the bonded portion forming step, the conductor bonded portion 17 and the conductor bonding part 7 are clamped between the anvil 21 and the horn 19 and the conductor bonded portion 17 is fixed in the conductor bonding part 7 in the bonded portion fixing step. However, in the bonded portion forming step and the bonded portion fixing step, the conductor 11 and the terminal 3 of the conductor bonding part 7 both may be clamped between the anvil 21 and the horn 19.

That is, in the bonded portion forming step, the conductor bonded portion 17 may be formed by clamping the conductor 11 and the conductor bonding part 7 of the terminal 3 between the anvil 21 and the horn 19 and ultrasonically vibrating the horn 19.

When being clamped between the anvil 21 and the horn 19 in the bonded portion forming step, the conductor 11 is positioned on the upper side and the conductor bonding part 7 of the terminal 3 is positioned on the lower side so that the conductor 11 and the conductor bonding part 7 of the terminal 3 overlap in the vertical direction VT. At this time, the anvil 21 is positioned under the conductor bonding part 7 of the terminal 3 and is in contact with the conductor bonding part 7, and the horn 19 is positioned on the conductor 11 and is in contact with the conductor 11.

Further, the bonded portion fixing step is performed simultaneously with the bonded portion forming step. For example, after the bonded portion forming step, the state where the conductor 11 and the conductor bonding part 7 of the terminal 3 are clamped d between the anvil 21 and the horn 19 and the horn 19 is then ultrasonically vibrated to integrally fix the bonded portion 17 of the conductor 11 in the conductor bonding part 7.

In addition, for example, operating conditions such as a force of holding by the anvil 21 and the horn 19, the vibration frequency of the horn 19, etc. may be changed in the bonded portion forming step and the bonded portion fixing step. Furthermore, the specifications of the anvil 21 and the horn 19 used in the bonded portion forming step may be different from the specifications of the anvil 21 and the horn 19 used in the bonded portion fixing step.

As described above, by clamping the conductor 11 and the conductor bonding part 7 of the terminal 3 between the anvil 21 and the horn 19, ultrasonically vibrating the horn 19 to perform ultrasonic bonding, the step of fixing the conductor 11 in the terminal 3 is simplified.

In addition, in the above description, the formation of the conductor bonded portion 17 and bonding of the conductor bonded portion 17 to the conductor bonding part 7 of the conductor bonded portion 17 are performed by ultrasonic bonding. However, the above-mentioned bonding may be performed by other treatments than the above-mentioned ultrasonic treatment, such as cold welding, friction stir welding, friction welding, electromagnetic welding, diffusion welding, brazing, soldering, resistance welding, electron beam welding, laser welding, and light beam welding.

What is claimed is:

1. A terminal-equipped electric wire, comprising:

a terminal including a conductor bonding part and a sheath supporting part; and an electric wire including a conductor formed of a plurality of strands and a sheath covering the conductor such that the conductor is exposed to a predetermined length, the conductor exposed from the sheath being bonded to the conductor bonding part, and the sheath being supported by the sheath supporting part and being fixed in the terminal, wherein the sheath supporting part is in a state where there is no permanent distortion with respect to a state when the terminal is present alone.

2. The terminal-equipped electric wire according to claim 1, wherein the sheath supporting part supports the electric wire with an urging force.

3. The terminal-equipped electric wire according to claim 1, wherein the sheath supporting part is a part of the terminal where a through hole is formed, and the electric wire passes through the through hole and the sheath of the electric wire is supported by the sheath supporting part by contacting an inner wall of the terminal defining the through hole.

4. The terminal-equipped electric wire according to claim 3, wherein the terminal is formed in a shape in which a flat plate-like material is bent in at least one portion to form a bent portion, the conductor bonding part is formed in one region of a plurality of regions partitioned by the bent portion, and the sheath supporting part is formed in another region of the plurality of regions partitioned by the bent portion.

5. The terminal-equipped electric wire according to claim 1, wherein the terminal includes a flat plate-like terminal body and a protruding part protruding from a plane of the flat plate-like terminal body in a thickness direction of the flat plate-like terminal body, the conductor bonding part is formed in a first part of the flat plate-like terminal body, the sheath supporting part is formed in an annular shape, along with the protruding part and a second part of the flat plate-like terminal body, and the electric wire passes through the sheath supporting part having the annular shape and the sheath of the electric wire is supported by the sheath supporting part by contacting at least the protruding part.

6. The terminal-equipped electric wire according to claim 5, wherein the protruding part includes a first protruding portion formed on a first region in the second part and protruding from a plane on one side of the flat plate-like terminal body in the plate thickness direction and a second protruding portion formed on a second region in the second part and protruding from a plane on the other side of the flat plate-like terminal body in the plate thickness direction, the first protruding portion, the second protruding portion, and the conductor bonding part are linearly arranged in this order in a longitudinal direction of the electric wire, the sheath supporting part includes the first protruding portion and the second protruding portion, and the electric wire is supported by the sheath supporting part by contacting the first protruding portion and the second protruding portion.

7. A method for manufacturing a terminal-equipped electric wire by fixing the electric wire including a conductor formed of a plurality of strands and a sheath configured to cover the conductor such that the conductor is exposed to a predetermined length, to the terminal including a conductor bonding part and a sheath supporting part, the method comprising:

supporting the sheath of the electric wire with the sheath supporting part being in a state where there is no permanent distortion with respect to a state when the terminal is present alone; and bonding an exposed conductor of the electric wire to the conductor bonding part of the terminal.

* * * * *